US010682643B2

(12) United States Patent
Sones et al.

(10) Patent No.: US 10,682,643 B2
(45) Date of Patent: Jun. 16, 2020

(54) FLUID FLOW DEVICE WITH FLOW CONTROL AND METHOD FOR MAKING THE SAME

(71) Applicant: University of Southampton, Hampshire (GB)

(72) Inventors: Collin Lawrence Sones, Southampton (GB); Robert William Eason, Southampton (GB); Ioannis Nikolaos Katis, Southampton (GB)

(73) Assignee: University of Southampton, Southampton, Hampshire (GB)

( * ) Notice: Subject to any disclaimer, the term of this patent is extended or adjusted under 35 U.S.C. 154(b) by 603 days.

(21) Appl. No.: 15/311,041

(22) PCT Filed: May 7, 2015

(86) PCT No.: PCT/GB2015/051338

§ 371 (c)(1),
(2) Date: Nov. 14, 2016

(87) PCT Pub. No.: WO2015/173543

PCT Pub. Date: Nov. 19, 2015

(65) Prior Publication Data

US 2017/0106367 A1 Apr. 20, 2017

(30) Foreign Application Priority Data

May 12, 2014 (GB) ..... 1408303.4
Jul. 1, 2014 (GB) ..... 1411711.3

(51) Int. Cl.

| | |
|---|---|
| ***B01L 3/00*** | (2006.01) |
| ***D21H 25/04*** | (2006.01) |
| ***D21H 25/06*** | (2006.01) |

(52) U.S. Cl.
CPC ..... *B01L 3/502707* (2013.01); *B01L 3/5023* (2013.01); *B01L 3/502746* (2013.01);
(Continued)

(58) Field of Classification Search
CPC ..... B01L 3/502707; B01L 3/5023; B01L 3/502746; B01L 2200/12;
(Continued)

(56) References Cited

U.S. PATENT DOCUMENTS 7,104,517 B1 * 9/2006 Derand ..... B01J 19/0093 251/11
2009/2981910 12/2009 Whitesides et al.
(Continued)

FOREIGN PATENT DOCUMENTS

CN 103437240 A 12/2013
WO 2008/049083 A2 4/2008
(Continued)

OTHER PUBLICATIONS

International Search Report and Written Opinion for corresponding Patent Application No. PCT/GB2015/051338 dated Jul. 30, 2015.
(Continued)

*Primary Examiner* — Samuel P Siefke
(74) *Attorney, Agent, or Firm* — Renner, Otto, Boisselle & Sklar, LLP

(57) ABSTRACT

A method of making a fluid flow device comprises: providing a substrate of porous material (2) impregnated with a light-sensitive substance (5) in a first state and which is configured to change from the first state to a second state when exposed to light (3), the second state being a solid state that is resistant to a solvent and the first being removable with the solvent; the substrate having a fluid flow channel (7) defined therein, the channel having a depth; exposing a beam of light (3) onto an area of the substrate surface within the
(Continued)

fluid flow channel to deliver energy to a volume of the substrate below the area to change the light-sensitive substance to the second state; during exposure, creating a partial barrier to flow of fluid along the channel by controlling the amount of energy delivered to the volume below at least part of the area to change the light-sensitive substance to the second state in a volume of the substrate within the fluid flow channel that has a depth less than the depth of the fluid flow channel; and developing the substrate in the solvent to leave the light-sensitive substance which is in the solid state and remove the light-sensitive substance which is in the other state. The device may be a medical diagnostic device, and the substrate may be a paper substrate or may be a nitrocellulose substrate.

18 Claims, 7 Drawing Sheets

(52) U.S. Cl.
CPC ..... *D21H 25/04* (2013.01); *D21H 25/06* (2013.01); *B01L 2200/12* (2013.01); *B01L 2300/0848* (2013.01); *B01L 2300/126* (2013.01); *B01L 2400/086* (2013.01)

(58) Field of Classification Search
CPC ..... B01L 2300/0848; B01L 2300/126; B01L 2400/086; D21H 25/06; D21H 25/04
See application file for complete search history.

(56) References Cited

U.S. PATENT DOCUMENTS

| | | | | |
|---|---|---|---|---|
| 2012/0238008 | A1* | 9/2012 | Henry | C12Q 1/04 435/288.7 |
| 2012/2889610 | | 11/2012 | Yager et al. | |

FOREIGN PATENT DOCUMENTS

| | | | |
|---|---|---|---|
| WO | 2010/022324 | A2 | 2/2010 |
| WO | 2012/125781 | A2 | 9/2012 |

OTHER PUBLICATIONS

Search Report for corresponding Patent Application No. GB 1408303.4 dated Dec. 3, 2014.
Yager et al.; "Microfluidic diagnostic technologies for global public health", Nature, vol. 442, pp. 412-418, Jul. 27, 2006.
Xu Li et al.; "A perspective on paper-based microfluidics: Current status and future trends", Biomicrofluidics 6, 011301, pp. 1-13, 2012.
Robert Pelton; "Bioactive paper provides a low-cost platform for diagnostics", Trends in Analytical Chemistry, vol. 28, No. 8, pp. 925-942, 2009.
Ali Kemal Yetisen et al.; "Paper-based microfluidic point-of-care diagnostic devices", Lab on a Chip, The Royal Society of Chemistry, 13, pp. 2210-2251, May 2013.
Martinez et al.; "Patterned Paper as a Platform for Inexpensive, Low-Volume, Portable Bioassays", Angewandte Chemie International Edition, Department of Chemistry and Chemical Biology, Harvard University, pp. 15-19, Feb. 2007.
Bruzewicz et al.; "Low-Cost Printing of Poly(dimethylsiloxane) Barriers to Define Microchannels in Paper", Analytical Chemistry, vol. 80, No. 9, pp. 3388-3392, May 1, 2008.
Koji Abe et al.; "Inkjet-Printed Microfluidic Multianalyte Chemical Sensing Paper", Analytical Chemistry, vol. 80, No. 18, pp. 6928-6934, Sep. 15, 2008.
Xu Li et al.; "Paper-Based Microfluidic Devices by Plasma Treatment", Analytical Chemistry, vol. 80, No. 23, pp. 9131-9134, Dec. 1, 2008.
Erin M. Fenton et al.; "Multiplex Lateral-Flow Test Strips Fabricated by Two-Dimensional Shaping", Applied Materials & Interfaces, vol. 1, No. 1, pp. 124-129, 2009.
Yao Lu et al.; "Rapid prototyping of paper-based microfluidics with wax for low-cost, portable bioassay", Electrophoresis Journal, 30, pp. 1497-1500, May 2009.
Emanuel Carrilho et al.; "Understanding Wax Printing: A Simple Micropatterning Process for Paper-Based Microfluidics", Analytical Chemistry, vol. 81, No. 16, pp. 7091-7095, Aug. 15, 2009.
Xu Li et al.; "Fabrication of paper-based microfluidic sensors by printing", Colloids and surfaces B: Biointerfaces 76, pp. 564-570, Apr. 2010.
Jacqui L. Delaney et al.; "Electrogenerated Chemiluminescence Detection in Paper-Based Microfluidic Sensors", Analytical Chemistry, vol. 83, pp. 1300-1306, 2011.
Juuso Olkkonen et al.; "Flexographically Printed Fluidic Structures in Paper", Analytical Chemistry, vol. 82, No. 24, pp. 10246-10250, Dec. 15, 2010.
Wijitar Dungchai et al.; "A low-cost, simple, and rapid fabrication method for paper-based microfluidics using wax screen-printing", Analyst, The Royal Society of Chemistry, 136, pp. 77-82, 2011.
Girish Chitnis et al.; "Laser-treated hydrophobic paper: an inexpensive microfluidic platform", Lab on a Chip, The Royal Society of Chemistry, Mar. 2011.
Amara Apilux et al.; "Development of automated paper-based devices for sequential multistep sandwich enzyme-linked immunosorbent assays using inkjet printing", Lab on a Chip, The Royal Society of Chemistry, 13, pp. 126-135, Nov. 2012.
Elain Fu et al.; "Controlled Reagent Transport in Disposable 2D Paper Networks", Lab on a Chip, The Royal Society of Chemistry, 10(7), pp. 918-920, Apr. 7, 2010.
Barry Lutz et al.; "Dissolvable fluidic time delays for programming multi-step assays in instrument-free paper diagnostics", Lab on a Chip, The Royal Society of Chemistry, 13(14), pp. 2840-2847, Jul. 21, 2013.
C. Sones et al.; "Laser patterning for paper-based fluidics", SPIE West: Microfluidcs, BioMEMS and Medical Microsystems XII, pp. 1-64, Feb. 2014.
Feinaeugle et al.; "Laser patterning for paper-based fluidics", Hot Topics at Photonics West, Bios SPIE Photonics West, 2014.

* cited by examiner

FLUID FLOW DEVICE WITH FLOW CONTROL AND METHOD FOR MAKING THE SAME

This application is a national phase of International Application No. PCT/GB2015/051338 filed May 7, 2015 and published in the English language, which claims priority to United Kingdom Patent Application Nos. 1408303.4 filed May 12, 2014 and 1411711.3 filed Jul. 1, 2014, which are all hereby incorporated herein by reference in their entirety.

BACKGROUND OF THE INVENTION

The present invention relates to devices configured to control the flow of fluid, and methods for making such devices.

Devices configured to deliver a fluid sample from a first location on the device to a second location, for example a test location provided with a reagent, are well-known. A particularly important application of such devices is in medical diagnostics, where a sample comprising a biological analyte is deposited on the device for flow to a test location for reaction with a reagent that tests for a disease or other clinical condition or parameter. Often the result of the test is indicated by a colour change at the test location. The device takes the form of a substrate that defines a fluid flow path or channel between the deposition site and the test site.

These devices are of great interest because the role of diagnostics and point-of-care (POC) testing is highly beneficial for early stage non-invasive clinical detection. POC testing provides an effective and rapid technique that excludes or minimises delay by providing a prompt exchange of vital information between the clinical care team and the patient, because the testing can be conducted at the point-of-care (which may be the patient's home, their general practitioner's clinic, or a hospital). The testing is facilitated through the use of uncomplicated, user-friendly and portable testing devices, and much effort has been directed towards producing diagnostic test-kits which are smaller, quicker and smarter, and importantly, cost-effective, which is a key requirement for enabling POC test procedures that may need to be performed repeatedly over large sample groups.

It has been recognised that microfluidic-based "lab-on-chip" (LOC) technology has considerable potential for medical diagnostics devices and systems [1]. Advantages of compact LOC devices include the use of smaller reagent volumes, faster reaction times and portability arising from the smaller device dimensions, and ease of manufacture. These devices were originally developed on platform substrates such as silicon and glass using clean-room based fabrication processes adapted from the semiconductor processing industry. Polydimethylsiloxane (PDMS), a low-cost polymer, has also been considered but has various limitations; this has led to a search for other substrate materials, which now include paper, cotton, thermoplastics and photocurable polymers. In particular, paper is now considered as a highly suitable substrate for the fabrication of LOC-type devices [2, 3]. Of particular importance is the relatively low-tech nature of paper, which has almost all of the attributes that would help realise 'low-cost' POC diagnostic tests, particularly in the context of low-resourced locations in developing and third-world countries.

As a substrate material, paper is inexpensive, abundantly available in a range of different engineered forms that exhibit different properties, can be stored and easily transported, modified in terms of its liquid transport properties, and readily disposed of after use. Additionally, paper-based fabrication procedures themselves are relatively cheap, and paper as a technology has been in use for more than two thousand years, lending itself to routine low cost high volume production procedures. Finally, delivery of paper-based items is routinely available to everyone world-wide that has access to a postal service. Paper is currently implemented for analytical and clinical chemistry, and chromatographic tests are routinely performed for the detection of different chemical species. Two commonly known paper-based chromatographic clinical tests are the pregnancy test and the lateral flow-based urine dipsticks that can simultaneously detect blood sugar, pH and ketone [4]. Clinical tests that can yield quantitative information of a multiplexed nature (i.e. can perform a series of parallel tests) using a single test strip are very attractive, and microfluidic paper-based analytical devices (μPADs) are an ideal platform for this. These paper-based microfluidic devices have one or more flow channels that are designed to guide and transport an analyte fluid from a point of entry on the device to a reaction zone that has been pre-treated with specific reagents. Unlike glass, silicon and polymer substrates on which fluid channels have to be surface-relief structures, for paper-based device the channels are formed within and extend throughout the thickness of the paper. The walls that are required to delineate the individual channels to contain and guide the flow of liquids are made from hydrophobic materials integrated into the structure of the paper.

An early design for these structures relied on a clean-room-based lithographic technique of exposure of a UV-sensitive polymer impregnated in a paper substrate through a custom-designed mask; this cross-linked the polymer to form the required pattern of fluid channels [5]. Lithography has also been proposed elsewhere [6, 7]. A development aimed at reducing costs arising from the lithographic procedure involved the use of a modified desktop plotter to dispense an ink composed of PDMS [8]. Other approaches include inkjet printer-based etching of paper impregnated with polystyrene [9], plasma-treatment through a metal mask of a paper impregnated with hydrophobic alkyl ketene dimer [10], paper-cutting using a computer-controlled X-Y knife plotter [11], printing of wax [12, 13], inkjet-printing [14, 15], flexographic printing [16], wax-screen printing [17], and laser-treatment of a paper with a hydrophobic coating [18]. Each of these techniques has its advantages and disadvantages. Lithography and plasma-treatment require expensive patterning masks or equipment and controlled laboratory conditions. The knife-plotting technique requires specialised or custom-modified patterning equipment, and other techniques may include undesirable post-processing procedures. Other issues are the limitation on achievable feature size resulting from lateral spreading of the hydrophobic material (for example with wax printing), the need for specialised chemicals and inks (for ink-jet printing), and the use of harsh chemical etchants.

Also, it is often desirable to control the fluid flow in the device so that the analyte flows along different channels at different speeds. The above fabrication techniques are often poorly suited to implement channel designs that offer the required flow rate control, and additional manufacturing steps can be needed to modify the channel network. Proposals for achieving flow rate control include using a circuitous or serpentine channel geometry to delay flow, and forming dissolvable barriers in the flow channels, for example made from sugar [19, 20, 21].

Hence, there is a requirement for improved microfluidic LOC-type devices, in particular devices in which the fluid flow speed can be modified or controlled, and improved methods for producing such devices.

SUMMARY OF THE INVENTION

Accordingly, a first aspect of the present invention is directed to a method of making a fluid flow device comprising: providing a substrate of porous material impregnated with a light-sensitive substance in a first state and which is configured to change state from the first state to a second state when exposed to light, one of the first state and the second state being a solid state that is resistant to a solvent and the other of the first and second state being removable with the solvent, the substrate having a fluid flow channel defined therein, and the channel having a depth; exposing a beam of light onto an area of the substrate surface within the fluid flow channel to deliver energy to a volume of the substrate below the area to change the light-sensitive substance to the second state; during exposure, creating a partial barrier to flow of fluid along the channel by controlling the amount of energy delivered to the volume below at least part of the area to change the light-sensitive substance to the second state in a volume of the substrate within the fluid flow channel that has a depth less than the depth of the fluid flow channel; and developing the substrate in the solvent to leave the light-sensitive substance which is in the solid state and remove the light-sensitive substance which is in the other state.

The method provides an attractively simple way to achieve fluid flow control in a substrate-based flow device such as a microfluidic device, by forming partial barriers to impede the fluid flow. In this way, the flow can be delayed or stopped, and fluid transportation through the device can be directed and controlled in a precise manner. The use of light-based state change of a light-sensitive substance by a light beam to create the partial barriers enables the method to be implemented as a "direct-write" procedure which is non-contact in nature; this is advantageous when fabricating devices for biological or biomedical applications. The barrier shape, size and location can be specified through simple modifications to the light parameters such as wavelength, power, intensity, and light pulse duration and repetition rate. Dimensions of the created solid structures can be less than 100 μm, offering reductions in device size. The method is a mask-less, non-lithographic procedure which is hence ideally suited for both preliminary trial-device fabrication and final device fabrication and production stages. The method can be readily scaled up for mass production, possibly on a roll-to-roll scale, while production costs for individual and bespoke devices can be very low.

In some embodiments, the porous material is paper or nitrocellulose. Other porous substrate materials could be used, however.

Controlling the amount of energy delivered by the light onto the area may comprise controlling an intensity of the light. Alternatively or additionally, directing the beam of light onto the area may comprise causing relative translation between the substrate surface and the beam of light, and controlling the amount of energy delivered by the light onto the area may comprise controlling a speed of the relative translation.

The partial barrier may be created to have a substantially constant depth along an intended direction of flow of fluid along the channel, by delivering a substantially equal amount of energy across the area. A barrier of this type can be introduced into a fluid flow channel to delay the flow of the fluid along the channel. Different barrier depths to and numbers of barriers can be selected to give precise flow rate control.

In other embodiments, the partial barrier may be created to have a depth which varies along an intended direction of flow of fluid along the channel, by delivering a varying amount of energy across the area. For example, the partial barrier depth may increase or decrease in a linear, a non-linear or a step-wise manner along the intended direction of flow of fluid along the channel. A barrier shaped in this way can offer different flow rates in opposite directions along the channel, or act as a one-directional flow device which allows flow in one direction while impeding flow in the opposite direction.

Partial barriers, because of their ability to delay fluids, can be used to separate different constituents of a fluid since each of the individual constituents would be delayed differently. This could in effect be useful for filtering-like applications which are much desired for example in the sample preparation stage of a diagnostic device.

The method may comprise creating one or more further partial barriers. Also, the substrate may have one or more further fluid flow channels defined therein. In this way, a fluid flow network with fluid control and defined fluid delay can be fabricated, which may be as complex or as simple as required for a particular fluid flow application.

In some embodiments, the second state of the light-sensitive substance is solid, the volume of light-sensitive substance changed to the second state forms the partial barrier, and developing the substrate comprises removing the light-sensitive substance in the first state. This can be thought of as a negative regime, in which those parts of the substrate required to be solid are exposed to light.

In a negative regime, the method may be extended such that providing the substrate having a fluid flow channel defined therein comprises: impregnating a substrate of porous material having a thickness with a light-sensitive substance in a first state and which is configured to change state from the first state to a second state on exposure to light, the second state being a solid state that is resistant to a solvent and the first state being removable with the solvent; exposing a beam of light onto the substrate surface; creating solid barrier walls to define the fluid flow channel by causing translational movement between the substrate surface and the beam of light to expose a pair of spaced-apart lines on the substrate while controlling an amount of energy delivered by the light so as to change the light-sensitive substance to the solid second state in a volume of the substrate below each line that extends through the thickness of the substrate; and developing the substrate in the solvent to remove light-sensitive substance in the first state. Hence, the same technique can be used to create both the fluid flow channel and the partial barrier.

Furthermore, the two fabrication stages can be combined, so that creating the solid barrier walls and creating the partial barrier are carried out as a combined step, following a single step of impregnating the substrate and before a single step of developing the substrate.

In other embodiments, the first state of the light-sensitive substance is solid, the partial barrier is formed by a volume of the substrate under the volume of light-sensitive substance changed to the second state, and developing the substrate comprises removing the light-sensitive material in the second state. This can be thought of as a positive regime, in which those parts of the substrate required to be solid are not exposed to light, while the parts intended to be hydrophilic to enable fluid flow are exposed to light.

Using a positive regime, the method may be extended such that providing the substrate having a fluid flow channel defined therein comprises: impregnating a substrate of porous material with a light-sensitive substance in a first state and which is configured to change state from the first state to a second state on exposure to light, the first state being a solid state that is resistant to a solvent and the second state being removable with the solvent; exposing a beam of light onto the substrate surface; creating the channel by causing translational movement between the substrate surface and the beam of light to expose a line having a width corresponding to a desired width of the channel while controlling an amount of energy delivered by the light so as to change the light-sensitive substance into the second state in a volume of the substrate below the line that extends a desired depth of the channel; and developing the substrate in the solvent to leave the light-sensitive substance in the solid first state and remove the light-sensitive substance in the second state. Depending on the type of light-sensitive substance used, the step of impregnating the substrate may comprise impregnating the substrate with a solution that forms the first state of the light-sensitive substance when heated, and heating the substrate to transform the solution into the light-sensitive substance in its first state.

As with the negative regime, the two fabrication stages can be combined under the positive regime, so that creating the channel and creating the partial barrier are carried out as a combined step, following a single step of impregnating the substrate and before a single step of developing the substrate, wherein creating the partial barrier comprises delivering a lesser amount of energy at part of the line than the energy delivered to change the light-sensitive substance to the second state to the desired depth of the channel.

A second aspect of the invention is directed to a fluid flow device fabricated using a method according to the first aspect of the invention.

A third aspect of the invention is directed to a fluid flow device comprising: a substrate of porous material; at least one fluid flow channel having depth in the substrate and defined by boundary walls within the substrate; and at least one partial barrier to flow of fluid along the at least one channel, the partial barrier comprising a volume of solid substance the porous material, the partial barrier located within the at least one channel and having a depth less than the depth of the channel. The boundary walls may be formed from solid substance in the porous material. The porous material may be paper or nitrocellulose.

The device may comprise at least one partial barrier having a substantially constant depth along an intended direction of flow of fluid along the channel. Alternatively or additionally, the device may comprise at least one partial barrier having a depth which varies along an intended direction of flow of fluid along the channel. The partial barrier depth may increase or decrease in a linear, a non-linear or a step-wise manner along the intended direction of flow of fluid along the channel.

In some embodiments, the boundary walls may comprise a pair of spaced apart lines of solid substance in the porous material that extend through a thickness of the substrate. In other embodiments, the boundary walls may comprise solid substance around a volume of porous material forming the channel.

A fluid flow device according to the second or third aspect may comprise or be a component for a diagnostic or test device or sensor. The diagnostic or test device or sensor may, for example, be configured for testing or diagnosis in one or more of the fields of medicine, environmental science, water pollution, food and drink, or pharmaceuticals.

BRIEF DESCRIPTION OF THE DRAWINGS

For a better understanding of the invention and to show how the same may be carried into effect reference is now made by way of example to the accompanying drawings in which.

DETAILED DESCRIPTION

Figure 1:
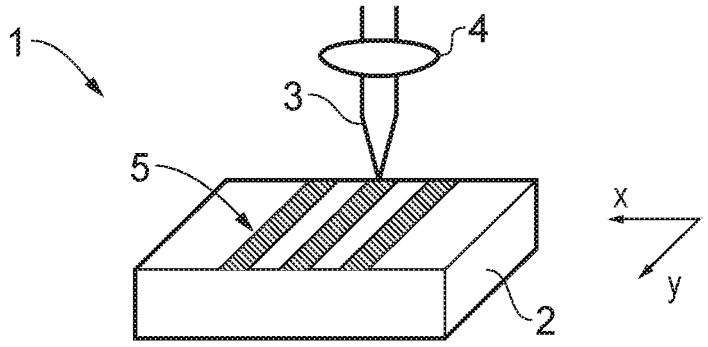
FIG. 1 shows a simplified schematic perspective view of a system for performing a method according to embodiments of the invention.

"Radiation" herein refers to any form of radiative energy, including energy transferred by waves or particles. Examples include electromagnetic radiation (including any part of the electromagnetic spectrum, e.g. radiofrequency radiation, microwaves, visible light, infrared radiation, ultraviolet radiation, X-ray radiation, gamma radiation etc.); radiation of particles (e.g. electron beam, ion beam, etc), or acoustic radiation (e.g. ultrasound).

"Radiation-sensitive substance" refers to any substance or combination of multiple substances which, when radiation is applied thereto, changes from a first state to a second state, where the substance is less permeable in one of the first state and the second state than the other. In some embodiments, the radiation-sensitive substance comprises one or more polymerisable substances, as described herein. In some embodiments. One of the first state and the second state may be a solid state that is resistant to a solvent and the other of the first and second state may be removable with the solvent.

"Light" herein refers to any form of electromagnetic radiation including any part of the electromagnetic spectrum, e.g. radio frequency radiation, microwaves, visible light, infrared radiation, ultraviolet radiation, X-ray radiation, gamma radiation, etc.

"Light-sensitive substance" refers to any substance or combination of multiple substances which, when light is applied thereto, changes from a first state to a second state.

The present invention is based on a newly-proposed technique for defining fluid flow channels in a substrate or membrane made from porous material, such as paper. The channels are defined by forming solid barriers and walls within the paper at each side of a channel by using a laser beam to "write" lines on the paper where the barriers and walls are required so that the energy delivered by the laser light changes the state of a light-sensitive substance soaked into the paper from a first state to a second state, one of which is solid and able to resist exposure to a developer solvent to remain within the substrate, and the other of which can be removed from the substrate by exposure to the solvent. The state change is induced in the volume of paper below the written lines (or other larger area if required). In this way, parts of the substrate are made solid and hence wholly or largely impermeable to fluid while other parts remain porous. The solid regions can be used to contain fluid at desired locations. The amount of light energy delivered governs the depth to which the light-sensitive substance changes state, so that by controlling the energy (by adjusting the laser power or the speed of writing, for example) one can control the depth of the solid features. A solid barrier formed through the full thickness of the paper can define a channel wall, so that a pair of spaced-apart elongate barriers together form a channel. The base of the channel may be defined by solid material, or by the surface of the paper. A barrier formed to a depth less than the paper thickness can be placed within the channel, between the side walls, and used to reduce the flow rate along the channel, since the presence of this partial barrier will impede fluid flow. Thus, a single fabrication process, namely writing a laser pattern onto an impregnated substrate, can be used to create both fluid flow channels and features within the channels to modify, adjust or control flow rate through those channels.

Light-Sensitive Substances

The invention relies upon using light to form and define regions of solid material and regions of porous material within a porous substrate such as paper. To achieve this, a light-sensitive substance is required. In the context of the present patent application, the term "light-sensitive substance" is intended to mean a substance which can be altered or changed from a first state to a second state by exposing the substance to light of an appropriate wavelength and intensity (which will depend on the particular substance). One of the states is a solidified or hardened state in which the substance takes the form of a material that can resist fluid and can therefore be used to create a physical barrier to fluid flow within the material of the substrate. This state is also resistant to a developer solvent so that the solid material remains within the substrate after a developing step. The other of the states is one which can be removed from the substrate material by a development process using the developer solvent, typically use of the solvent as a bath or otherwise applied to the substrate. The developing stage therefore leaves the substrate with some regions within it being solid, where the solid form of the light-sensitive substance is retained impregnated within the substrate material, and some regions which have no light-sensitive substance and are hence porous (hydrophilic), being comprised of the original substrate material. Either or both of the states of the light-sensitive substance may be hydrophobic, and both states might be solid or near-solid, but it is important that one solid state resists the developer solvent, while the other state is removable by the solvent (regardless of its other properties).

Any light-sensitive substance, compound, chemical or material which behaves in this way and which can be impregnated into the substrate material can be employed in the present invention. The impregnation process may involve one or more steps, and the resulting first state of the light-sensitive substance impregnated in the substrate may be a solid or a liquid.

The light-sensitive substance may be transformed under the light exposure from a first state to a second, solid, state, or from a first, solid, state to a second state. Accordingly, the light-writing can be performed under one of two regimes to create the desired pattern of solid, fluid-resistant structures within the substrate. A first regime can be considered as a negative regime, in which the second state of the light-sensitive substance is solid and retained within the substrate material. Thus, exposure of the substrate to the light forms solid material in the exposed parts, and the light-sensitive substance still in the first state is then removed from the unexposed parts of the substrate by developing. Conversely, a positive regime is one in which the first state of the light-sensitive substance is solid. Exposure of the substrate to the light turns the solid material into a second state in which it can be removed by the developer solvent. So, in the negative regime the light beam writes or creates the solid structures, and in the positive regime the light beam writes or creates the porous structures. Implementation of the invention according to the two regimes is described further below.

It is also possible to use a radiation-sensitive substance as defined above, which may be sensitive to forms of radiation other than light. A light-sensitive substance is a particular example of a radiation-sensitive substance.

Radiation-sensitive substances or light-sensitive substances suitable for use in the invention include materials sometimes referred to as polymerisable substances, photoresists, and light-curable resins and adhesives.

Typically, the polymerisable substance is a substance containing molecules (monomers) which, on the application of light, bond to one another to form a polymer. The polymer may be more permeable or less permeable than the polymerisable substances from which it is formed. Typically, the polymer is less permeable than the polymerisable substances from which it is formed. In some examples, the more permeable state may be a liquid state and the less permeable state may be a state which is more solid, firm or hard.

The polymerisable substance may comprise (or consist of) a monomer molecule. In this specification the term "monomer molecule" means a molecule capable of undergoing polymerisation to thereby form the constitutional units of a polymer.

The polymer formed from the monomer molecules is typically an organic polymer. A large number of organic polymers are known in the art. Examples of particular classes of organic polymers suitable for use according to the present invention include polyolefins, polyesters, polycarbonates, polyamides, polyimides, polyether sulfones, and mixtures or derivatives thereof.

In the technique of the present invention, the monomer molecule is typically capable of light-initiated polymerisation (i.e. polymerisation initiated by the application of radiation, as defined herein). Examples of such monomer molecules include ethylenically unsaturated monomers. Any compound having a carbon-carbon double bond and which is capable of being polymerised by the application of radiation may function as an ethylenically unsaturated monomer.

In one embodiment, the ethylenically unsaturated monomer may be an olefin: in other words, an unsubstituted, unsaturated hydrocarbon (such as ethylene, propylene, 1-butene, 1-hexene, 4-methyl-1-pentene or styrene). In this specification polymers formed by polymerising such monomers are termed 'polyolefins'.

In another embodiment, the ethylenically unsaturated monomer is an ethylenically unsaturated hydrocarbon substituted with one or more functional groups; examples of such functional groups include the substituents defined and exemplified below in relation to the substituent group $R_2$ on an acrylate or methacrylate group; further examples include halogen atoms, particularly fluorine atoms (examples of olefins substituted with such groups include vinylidene fluoride or tetrafluoroethylene) or chlorine atoms (examples of olefins substituted with such groups include vinyl chloride and vinylidene dichloride), carboxylic acid or carboxylic ester groups (examples of olefins substituted with such groups include acrylic or methacrylic monomers, as described and exemplified below), nitrile groups (examples of olefins substituted with such groups include acrylonitrile and methacrylonitrile). In this specification polymers formed by polymerising such monomers are termed 'substituted polyolefins'.

In one embodiment, the ethylenically unsaturated monomer is a (meth)acrylate monomer. These are monomers of the formula:

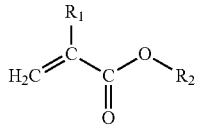

wherein $R_1$ is hydrogen or methyl, and $R_2$ is hydrogen or a substituent, or two groups $R_2$ together form a linker group. When $R_1$ is hydrogen, the monomer is an acrylate monomer. When $R_1$ is methyl, the monomer is a methacrylate monomer.

When $R_2$ is a substituent, the substituent may comprise or consist of a hydrocarbyl group, typical examples of which include alkyl, alkenyl, alkynyl, cycloalkyl, heterocyclyl, aryl and heteroaryl groups. In one embodiment the substituent may comprise or consist of an alkyl group. In this specification the term "alkyl group" means a saturated, monovalent, hydrocarbon moiety. The alkyl group is typically a $C_{1-30}$ alkyl group, such as a $C_{1-10}$ alkyl group, such as a $C_{1-8}$ alkyl group, such as a $C_{1-4}$ alkyl group, such as a methyl, ethyl, n-propyl, isopropyl, n-butyl, isobutyl, sec-butyl, or tert-butyl. The alkyl group may be substituted with one or more (typically only one) substituent, examples of which include halogen (especially fluorine or chlorine), hydroxy, nitrile (—CN), carboxylic acid (—$CO_2H$) and carboxylic ester (—$CO_2R'$) where R' is hydrogen or a substituent, typically a $C_{1-6}$ alkyl group or a benzyl group.

In one embodiment the substituent may comprise or consist of an alkenyl group. In this specification the term "alkenyl group" means a monovalent, hydrocarbon moiety having at least one carbon-carbon double bond. The alkenyl group is typically a $C_{2-10}$ alkenyl group, such as a $C_{2-6}$ alkenyl group. The alkenyl group may be substituted with one or more (typically only one) substituent, examples of which include halogen (especially fluorine or chlorine), hydroxy, nitrile (—CN), carboxylic acid (—$CO_2H$) and carboxylic ester (—$CO_2R'$) where R' is hydrogen or a substituent, typically a $C_{1-6}$ alkyl group or a benzyl group.

In one embodiment the substituent may comprise or consist of an alkynyl group. In this specification the term "alkynyl group" means a monovalent, hydrocarbon moiety having at least one carbon-carbon triple bond. The alkynyl group is typically a $C_{2-10}$ alkynyl group, such as a $C_{2-6}$ alkynyl group. The alkenyl group may be substituted with one or more (typically only one) substituent, examples of which include halogen (especially fluorine or chlorine), hydroxy, nitrile (—CN), carboxylic acid (—$CO_2H$) and carboxylic ester (—$CO_2R'$) where R' is hydrogen or a substituent, typically a $C_{1-6}$ alkyl group or a benzyl group.

In one embodiment the substituent comprises or consists of a cycloalkyl group. In this specification the term "cycloalkyl group" means a monovalent, saturated, cyclic hydrocarbon group. The cycloalkyl group is typically a $C_{3-10}$ cycloalkyl group, such as a $C_{3-8}$ cycloalkyl group, such as a $C_{4-6}$ cycloalkyl group. The cycloalkyl group may be substituted with one or more (typically only one) substituent, examples of which include halogen (especially fluorine or chlorine), hydroxy, nitrile (—CN), carboxylic acid (—$CO_2H$) and carboxylic ester (—$CO_2R$) where R is hydrogen or a substituent, typically a $C_{1-6}$ alkyl group or a benzyl group.

In one embodiment the substituent comprises or consists of a heterocyclyl group. In this specification the term "heterocyclyl group" means a monovalent, saturated, cyclic group, having 1 to 4 heteroatoms selected from nitrogen, oxygen and sulphur. The heterocyclyl group is typically a 5- or 6-membered heteroaryl group, such as a tetrahydrofuryl, pyrrolidinyl, tetrahydrothienyl, oxazolidinyl, isoxazolidinyl, thiazolidinyl, isothiazolidinyl, thiadiazolidnyl, piperidinyl, piperazinyl or morpholinyl group. The heterocyclyl group may be substituted with one or more substituent, examples of which include halogen (especially fluorine or chlorine), hydroxy, nitrile (—CN), carboxylic acid (—$CO_2H$) and carboxylic ester (—$CO_2R$) where R is hydrogen or a substituent, typically a $C_{1-6}$ alkyl group or a benzyl group.

In one embodiment the substituent comprises or consists of an aryl group. In this specification the term "aryl group" means a monovalent, unsaturated, aromatic group (ie an unsaturated group having 4n+2 pi electrons, where n is an integer, preferably 1 or 2). The aryl group is typically a $C_{6-10}$ aryl group, such as a phenyl or naphthyl group. The aryl group may be substituted with one or more substituent, examples of which include halogen (especially fluorine or chlorine), hydroxy, nitrile (—CN), carboxylic acid (—$CO_2H$) and carboxylic ester (—$CO_2R$) where R is hydrogen or a substituent, typically a $C_{1-6}$ alkyl group or a benzyl group.

In one embodiment the substituent comprises or consists of a heteroaryl group. In this specification the term "heteroaryl group" means a monovalent, unsaturated, aromatic group, having 1 to 4 heteroatoms selected from nitrogen, oxygen and sulphur. The heteroaryl group is typically a 5- or 6-membered heteroaryl group, such as a furyl, pyrrolyl, thienyl, oxazolyl, isoxazolyl, thiazolyl, isothiazolyl, triazolyl, thiadiazolyl, tetrazolyl, pyridyl, pyrimidyl, pyrazinyl or triazinyl group. The heteroaryl group may be substituted with one or more substituent, examples of which include halogen (especially fluorine or chlorine), hydroxy, nitrile (—CN), carboxylic acid (—$CO_2H$) and carboxylic ester (—$CO_2R$) where R is hydrogen or a substituent, typically a $C_{1-6}$ alkyl group or a benzyl group.

Examples of acrylate and methacrylate monomers include acrylic acid ($R_1$ and $R_2$ are H) methacrylic acid ($R_1$ is methyl and $R_2$ is H), and acrylic and methacrylic esters such as methyl acrylate ($R_1$ is H and $R_2$ is methyl), ethyl acrylate ($R_1$ is H and $R_2$ is ethyl), 2-ethylhexyl acrylate ($R_1$ is H and $R_2$ is 2-ethylhexyl), hydroxyethyl methacrylate ($R_1$ is H and $R_2$ is 2-hydroxyethyl), butyl acrylate ($R_1$ is H and $R_2$ is butyl) and butyl methacrylate ($R_1$ is methyl and $R_2$ is butyl).

When two groups $R_2$ together form a linker group, the monomer is a diacrylate or dimethacrylate. The linker group may be an aliphatic chain (for example an alkylene group or an oxyalkylene group), an alicyclic linker ring (for example a cycloalkylene, arylene or heteroarylene ring), or a combination thereof.

In one embodiment the linker group comprises or consists of an alkylene group. In this specification the term "alkylene group" when used to define the linker group means an aliphatic, saturated, divalent, hydrocarbon moiety. The alkylene group is typically a $C_{1-30}$ alkylene group, such as a $C_{1-10}$ alkylene group, such as a $C_{1-6}$ alkylene group, such as a $C_{1-4}$ alkylene group, such as a methylene, ethylene, methylmethylene, propylene or butylene group, and especially an ethylene group. The alkylene group may be substituted with one or more (typically only one) substituent, examples of which include halogen (especially fluorine or chlorine), hydroxy, nitrile (—CN), carboxylic acid (—$CO_2H$) and carboxylic ester (—$CO_2R$) where R is hydrogen or a substituent, typically a $C_{1-6}$ alkyl group or a benzyl group. In one embodiment, the substituent on the alkylene group links the alkylene group to the rest of the linker group, such as those defined and exemplified below.

In one embodiment the linker group comprises or consists of a cycloalkylene group. In this specification the term "cycloalkylene group" when used to define the linker group means a divalent, saturated hydrocarbon group. The cycloalkylene group is typically a $C_{3-10}$ cycloalkylene group, such as a $C_{3-8}$ cycloalkylene group, such as a $C_{4-6}$ cycloalkylene group. The cycloalkylene group may be substituted with one or more (typically only one) substituent, examples of which include halogen (especially fluorine or chlorine), hydroxy, nitrile (—CN), carboxylic acid (—$CO_2H$) and carboxylic ester (—$CO_2R$) where R is hydrogen or a substituent, typically a $C_{1-6}$ alkyl group or a benzyl group. In one embodiment, the substituent on the cycloalkylene group links the cycloalkylene group to the rest of the linker group, such as those defined and exemplified below.

In one embodiment the linker group comprises or consists of an arylene group. In this specification the term "arylene group" when used to define the linker group means a divalent, unsaturated, aromatic group. The arylene group is typically a $C_{6-10}$ arylene group, such as a phenylene group or naphthylene group. The arylene group may be substituted with one or more substituent, examples of which include halogen (especially fluorine or chlorine), hydroxy, nitrile (—CN), carboxylic acid (—$CO_2H$) and carboxylic ester (—$CO_2R$) where R is hydrogen or a substituent, typically a $C_{1-6}$ alkyl group or a benzyl group. In one embodiment, the substituent on the arylene group links the arylene group to the rest of the linker group, such as those defined and exemplified below.

In another embodiment the linker comprises or consists of an oxyalkylene or polyoxyalkylene group. An oxyalkylene group has the formula:

$$—[CH(R_1)—CH(R_2)—O]—_n$$

wherein $R_1$ and $R_2$ are hydrogen or a $C_{1-4}$ alkyl group, such as a methyl group, and n is typically 1 to 350, such as 1 to 100, such as 1 to 50, such as 1 to 20, such as 1, 2, 3, 4, 5, 6, 7, 8, 9, or 10. When n is 1, the linker comprises an oxyalkylene group: when n is 2 or more, the linker comprises a polyoxyalkylene group. Typically the linker group is a oxyethylene or polyoxyethylene group (i.e. wherein $R_1$ and $R_2$ are hydrogen).

In another embodiment the linker comprises or consists of an ester (—C(=O)—O—) group. In another embodiment the linker comprises or consists of an amide (—C(=O)—N(R")—) group, where R" is hydrogen or a substituent, typically a $C_{1-6}$ alkyl group or a benzyl group. In another embodiment the linker comprises or consists of an ether (—O—) group.

In one embodiment, the linker comprises or consists of a urethane (—O—C(=O)—NR"—) group (where R" is as defined above).

In one embodiment, the linker group comprises both an alkylene group (as defined and exemplified above) and an oxyalkylene or polyoxyalkylene group (as defined above). The linker group may comprise an oxyalkylene or polyoxyalkylene group having two alkylene termini. In this embodiment, the oxyalkylene or polyoxyalkylene group may be bonded directly to the two alkylene termini or may be bonded via a linker group, typically an ester group.

In one embodiment, the linker group comprises both an alkylene group, cycloalkylene group and/or an arylene group (as defined and exemplified above) and one or more urethane groups (as defined above). In one embodiment, the linker group may an alkylene, cycloalkylene group/or an arylene group having two urethane termini. In this embodiment, the alkylene, cycloalkylene group/or an arylene group may be bonded directly to the two urethane termini or may be bonded via a further linker group, such as those defined and exemplified above.

Examples of such diacrylates and dimethacrylates include alkylene diacrylate or dimethacrylates (where two groups $R_2$ together form alkylene, as defined and exemplified above, especially ethylene glycol diacrylate or dimethacrylate) and glycol ether diacrylates and dimethacrylates, such as polyalkylene glycol diacrylates and polyalkylene glycol dimethacrylates, where two groups $R_2$ together form an oxyalkylene or polyoxyalkylene group, as defined and exemplified above) polyethylene glycol dimethacrylate. The polyethylene glycol moiety of polyethylene glycol diacrylates and polyethylene glycol dimethacrylates typically has an average molecular weight ranging from 200 to 20,000, typically 200 to 1000.

Further examples of such diacrylates and dimethacrylates include urethane diacrylates or dimethacrylates (where two groups $R_2$ together form a linker including a urethane linkage, as defined and exemplified above). A particular example is the urethane di(meth)acrylate sold as OP-66-LS by DYMAX Corporation.

Further examples of acrylates include the acrylate monomer sold as ABELUX A4061T by DYMAX Corporation.

In another embodiment, the monomer is a mercapto ester. As is known to the person skilled in the art, mercapto esters have the formula R—C(=O)—SR' wherein R and R' are substituents, as defined above in relation to the substituents $R_2$ on an acrylate or methacrylate group, especially, alkyl, aryl or heteroaryl groups. These may be copolymerised with a number of other co-monomers, such as triallyl isocyanurate (CAS No. 1025-15-6) or tetrahydro-2-furanylmethyl methacrylate. Examples of co-monomer mixtures include those sold as Norland 61 and Norland 68 by Norland Products Incorporated.

The polymer formed from the monomers may be cross-linked. Typically, a cross-link is a region in the polymer from which at least four chains emanate, and is typically formed by reactions involving sites or groups on the existing polymer structure or by interactions between existing polymers. The region may be a direct bond between the polymer chains, a single atom (such as an oxygen or sulphur atom), a group of atoms (such as an alkylene group or alkyleneoxy group, as defined and exemplified above), or a number of branch points connected by bonds, groups of atoms, or oligomeric chains.

Cross-linking of the polymer chains can result in a network polymer. The degree of cross-linking of a network polymer may vary depending on the nature of the polymer and the conditions and reagents used to produce it. Examples of suitable reagents and conditions are well known to those skilled in the art. The degree of cross-linking can influence the mechanical strength of the polymer and the degree of permeability to a fluid.

The polymerisable substance may be polymerised by any method known to those skilled in the art. Examples of polymerisation methods include radical polymerisation (in which the reactive species which carry the polymerisation chain reaction are free radicals), cationic polymerisation (in which the reactive species which carry the polymerisation chain reaction are cations), anionic polymerisation (in which the reactive species which carry the polymerisation chain reaction are anions), or any combination thereof. It is preferred that the polymerisation method is radical polymerisation, as this mechanism is most easily induced by radiation.

In one embodiment, the monomer is polymerised in the presence of a photoinitiator. A photoinitiator is a chemical compound that decomposes into free radicals when radiation is applied. The photoinitiator may be a Type I or Type II photoinitiator. Type I photoinitiators undergo cleavage upon irradiation to generate two free radicals in which only one is reactive and proceeds to initiate polymerization. Type II photoinitiators form an excited state (e.g. a triplet state) upon irradiation but must abstract an atom or electron from a donor synergist, which then acts as the initiator for polymerization.

Examples of photoinitiators are well known to those skilled in the art. Examples of Type I photoinitiators include azobis(isobutyronitrile) (AIBN), peroxides such as benzoyl peroxide, benzoin ethers, benzil ketals, α-dialkoxyacetophenones, α-aminoalkylphenones, α-hydroxyacetophenones, and acyl phosphine oxides. Examples of Type II photoinitiators include diaryl ketones (benzophenones) such as benzophenone and substituted benzophenones, thioxanthones such as isopropyl thioxanthone and 2,4-diethylthioxanthone, and quinones such as benzoquinone, camphorquinone and anthraquinone.

In one embodiment, the radiation sensitive material comprises (or consists of) a photoresist. Photoresists are classified into two groups: positive resists and negative resists. In the context of the present technique, the term "positive resist" means a type of photoresist in which the portion of the photoresist that is exposed to radiation becomes more permeable to the fluid intended to be received, contained, and/or guided during use of the device. The portion of the positive photoresist that is unexposed remains less permeable to the fluid. In contrast, in the context of the present technique, the term "negative resist" means a type of photoresist in which the portion of the photoresist that is exposed to radiation becomes less permeable to the fluid intended to be received, contained, and/or guided during use of the device. The unexposed portion of the negative photoresist remains more permeable to the fluid. In one embodiment, the photoresist is a negative photoresist.

The invention is not limited to any particular radiation-sensitive substance. Radiation-sensitive, light-sensitive or photosensitive materials other than those described above but which nevertheless behave in a similar manner may be used to implement the various embodiments of the invention. The type of radiation (e.g. wavelength of electromagnetic radiation) and the level of energy density needed will depend on the choice of radiation-sensitive substance and the thickness and structure of the substrate. Also, the type of developer solvent used may depend on the choice of substance. Various radiation-sensitive substances may require more than one form of radiation exposure, e.g. a heat treatment after a light exposure stage to harden or produce the required properties; methods according to various embodiments of the invention may include such a step if necessary.

As examples of radiation-sensitive substances, the inventors have used the polymerisable substances DeSolite (registered trade mark) 3471-3-14 (from DSM Desotech Inc. or Chemtrec International, USA), in which the monomer is a glycol ether acrylate, and SUBSTANCE G (from Maker-Juice, USA), in which the monomer is an acrylate ester, to implement embodiments of the invention. As mentioned, however, other radiation-sensitive substances with the appropriate characteristics could be used.

Fluid Flow Channels

Some information regarding the light-writing technique as used to create fluid flow channels by creating solid barriers extending through the full thickness of a paper substrate has been presented at the SPIE Photonics West conference in February 2014 ("Laser patterning for paper-based fluidics", C. L. Sones, I. N. Katis, B. Mills, M. Feinaeugle, M. F. Namiq, M. Ibsen and R. W. Eason).

According to embodiments of the invention, inscription of the desired pattern of fluidic flow channels in paper is achieved via a laser-based direct-write procedure that is based on the principle of light-induced photo-polymerisation. As with known laser direct-write procedures for other applications, the method uses scanning of a light beam from a laser across the surface of the work-piece or substrate, which in some embodiments is paper. This relative translational movement of the light beam and the substrate can be achieved by movement of the light beam across a stationary substrate, movement of the substrate with respect to a stationary light beam, or a combination of the two. Computer control of scanning stages holding the substrate or the laser, and/or mirrors and lenses to direct the light beam, can be used to automatically and precisely define the pattern of writing, in a repeatable yet easily modifiable way. Hence, mass production, prototype manufacture and small production runs can be readily achieved with the same apparatus.

FIG. 1 shows a highly simplified schematic representation of a system 1 for performing a method according to embodiments of the invention. A planar substrate 2 of paper impregnated with a light-sensitive substance in the form of a photopolymer is provided. A laser (not shown) delivers a light beam 3 which is focussed using one or more mirrors or lenses 4 and directed onto the surface of the substrate 2.

Relative translation in the X and Y directions (in the plane of the substrate) between the substrate surface and the light beam is used to trace or write a pattern of lines on the surface of the substrate 2. The light delivers energy into the substrate and acts to cross-link/polymerise the photopolymer (changing it from its first state into its second state) below the sites or areas (the written lines) of light exposure, thereby creating a series of solidified polymer lines (walls or barriers) within the substrate. In this example, a set of three parallel lines 5 has been written.

Figure 2:
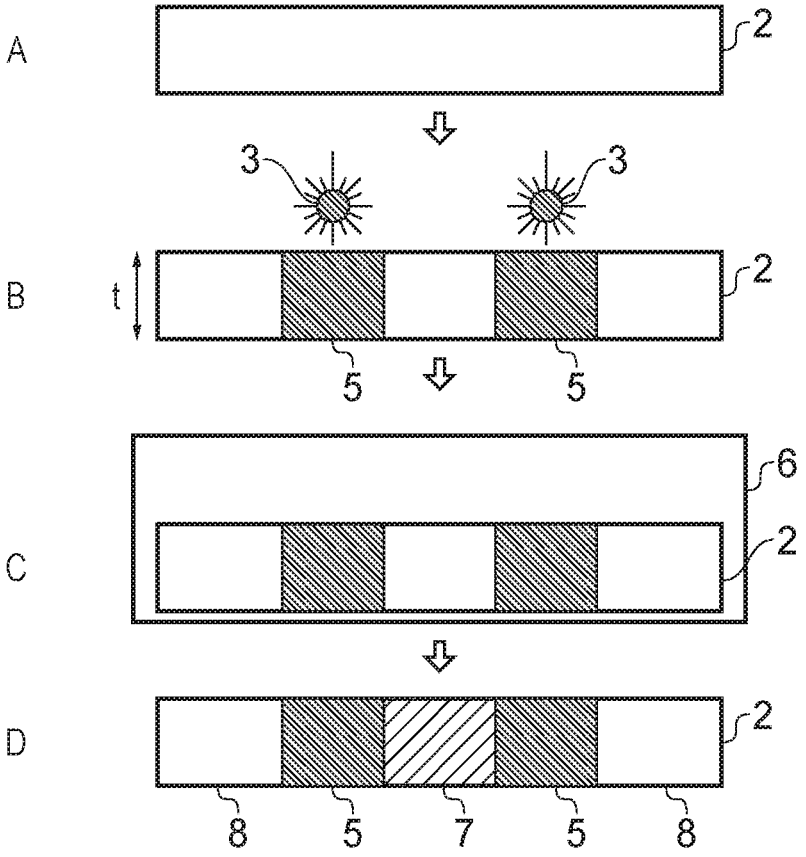
FIG. 2 shows a schematic illustration of steps in a method according to an embodiment of the invention.

FIG. 2 shows a schematic illustration of various steps in this process, as side views of the substrate. In step A (impregnation), the porous substrate 2 is impregnated with the light-sensitive curable photopolymer (also variously called resist, resin or adhesive), by soaking it in a solution of the photopolymer. In step B (exposure), the focussed light beam 3 is scanned directly over the surface of the substrate 2 to write the required pattern of lines, in this example two lines. Under each line, a volume of the substrate which has been exposed to a sufficient amount of light energy experiences polymerisation of the photopolymer as it is changed from the first, liquid, state to the second, solid (and in this example, also hydrophobic), state so that two walls of solid polymer 5 are formed. The walls extend through the thickness t of the substrate, from the top surface to the bottom surface. In step C (development), the substrate 2 is developed by immersion in a solvent which acts to remove the unpolymerised substance (those volumes of photopolymer still in the first state) from the substrate 2, leaving the plain, untreated and hence hydrophilic substrate material in those parts of the substrate that have not been exposed to the light beam. Step D shows the finished substrate (which may be a finished device, or may require further manufacturing steps to produce the device). The two solid walls 5 form boundaries for a region of the substrate between the walls 7 which has not been polymerised so now comprises plain substrate material, and which is hence the fluid flow channel 7 since the walls 5 will act to confine fluid introduced into that region so that it flows along the channel by wicking. On the other sides of the walls 5, the substrate is also plain untreated substrate material 8.

As an example, consider the following experiment that was carried out to form channels in a paper substrate. Before the laser writing, the paper was impregnated with the light-sensitive substance, by soaking it for a few seconds in a solvent-based solution of photopolymer. The ratio of the photopolymer to the solvent (iso-propyl alcohol in this example) was 1:4. The photopolymer-impregnated paper substrate was then treated to remove any excess solution from the top of the substrate and left to dry for a few hours under ambient laboratory conditions. Other photopolymers and photoresists may also need a heating or baking step to harden at this stage of the method.

For the step of laser writing or the direct-write pattern definition, a Nd:$YVO_4$ laser operating at 266 nm (an ultraviolet (UV) wavelength) with a pulse duration of 10 ns and pulse repetition rate of 20 Hz was used. The UV laser beam was directed towards the paper substrate which was mounted on a xyz-translational stage. A plano-convex cylindrical lens (f=36 mm) was used to focus the laser beam onto the surface of the paper substrate, and translation of the substrate in the two planes (x and y, in the plane of the substrate, parallel to the surface) perpendicular to the incident laser beam allowed for scanning of two-dimensional user-defined patterns on the paper surface. Translation along the third axis of the stage (z, orthogonal to the substrate plane) was used to optimise the position of the paper substrate with respect to the focal plane of the lens.

The laser illumination of the impregnated paper induced polymerisation only within the volume of the paper under the laser-exposed areas through initiation of light-induced cross-linking of the constituent molecules in the photopolymer (polymerisation). By varying energy density through changes in the exposure parameters of the laser (such as power and/or spot size of the light beam to alter the intensity) and the speed of translation of the paper, the extent of local polymerisation could be adjusted. These parameters play a crucial role in determining both the width and depth of the regions polymerised, and through variations in the incident laser exposure it is possible to produce polymerised structures that extend throughout any desired thickness of the paper substrate (from surface only to the full paper thickness). To form an effective fluid flow channel, the polymerisation should extend through the full paper thickness to prevent leakage of the fluid from the channel. The final step in the fabrication procedure was to wash away the photopolymer remaining in its original first state from the paper substrate. This was done by immersing the paper in a solution of iso-propyl alcohol for 30 seconds. As an end result, a paper substrate with user-defined solid fluid-resistant regions that had been selectively polymerised through the laser direct-write step was obtained.

Using a method of this type, the laser scanning of parallel lines spaced apart by the desired width for a fluid flow channel along the surface of a paper substrate under the correct conditions creates photo-polymerisation induced barriers walls that define a fluidic channel.

A range of experiments was conducted to explore the conditions for achieving optimum photo-polymerisation; these involved varying the laser exposure, the substrate translation speed, and the focal spot size. The range of substrate translational speeds was varied from 0.05 mm/s to 0.5 mm/s, with corresponding variation of incident average powers ranging from ~7 mW through to ~10 mW (or energies of ~0.35 mJ to ~0.5 mJ per pulse). The paper substrates were positioned at a distance of 10 mm away from the focal point, and the corresponding dimension of the laser spot was ~0.3 mm×1 mm. The corresponding incident fluence hence ranged from 4.6 J/$cm^2$ to 46 J/$cm^2$. The paper used was Whatman (registered trade mark) Grade 1, a cellulose paper with a thickness of 180 μm which is manufactured and sold for use as a filter paper. Other papers or porous materials may be used for the substrate or membrane, however. A particular example is nitrocellulose, which is discussed further below.

Figure 3:
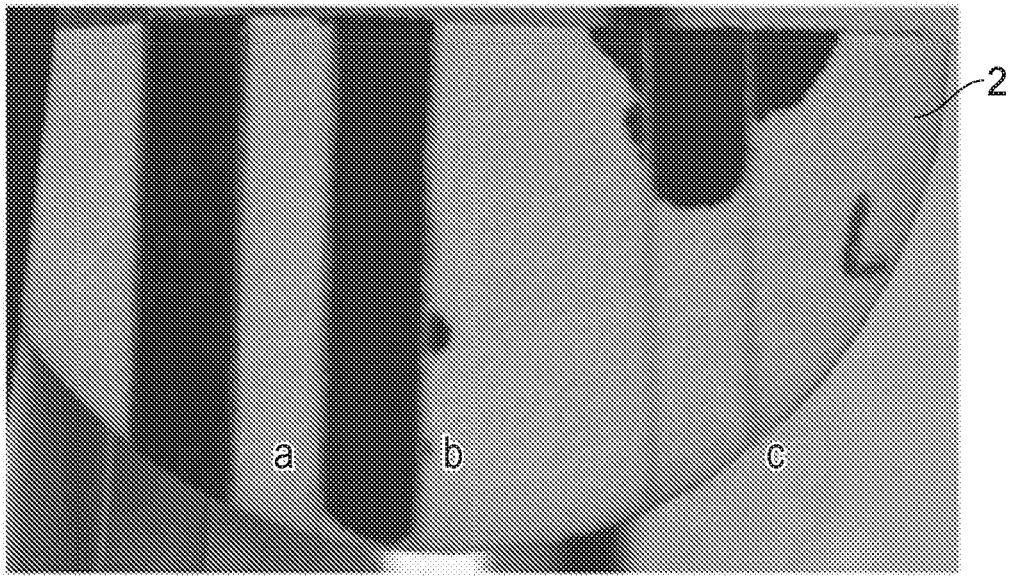
FIGS. 3 and 4 show photographic images of processed paper substrates produced using a method according to embodiments of the invention.

FIG. 3 shows a photograph of a processed paper substrate produced in these experiments. The paper has three pairs of parallel barrier walls defining three fluid flow channels a, b, c in the substrate 2. Each pair of walls was polymerised by translating the substrate at a different speed, namely, 0.06 mm/s for channel a, 0.08 mm/s for channel b and 1.0 mm/s for channel c, with the incident average laser power maintained at 7 mW. After fabrication, an ink solution was pipetted into the channels (at the ends depicted in the top of the photograph) to test the integrity of the structures and wicking (flow) ability of the channels. The ink was pipetted from one side of each channel in 3 μl droplets, until the channel was filled or a leak was observed. The ink appears in the photograph as the dark areas. It was found that the polymerisation depth of the barrier walls for channel c was about 60% of the thickness of the paper and for channel b was about 75% of the thickness of the paper, while for channel a the barrier walls extended throughout the full (100%) thickness of the 180 μm thick paper. As shown in FIG. 3, when the ink was introduced at one end of this channel, the ink was fully contained within the channel and guided from one end of the channel to the other. However, since the barrier walls for the two other channels did not extend through the entire thickness of the paper, these channels were unable to properly contain the ink, resulting in the leaking out of the ink from either side of the channel walls. As is clear from FIG. 3, the leakage was more severe in channel c, which had the least deep channel barrier walls.

Further experiments were conducted to establish the optimal writing speed that would produce barrier walls extending throughout the entire thickness of the paper to produce secure fluid flow channels. Writing speeds slower and faster than 0.07 mm/s were trialled. Varying the writing/scanning speed for a constant laser power and spot size varies the amount of energy delivered through a given surface area of the paper and hence affects the depth of polymerisation that is produced under that area. A faster speed delivers less energy per area, so the energy penetrates less deeply into the paper and produces a shallower polymerisation region. In the experiments, speeds greater than 0.07 mm/s resulted in walls that did not extend through the paper, while speeds slower than 0.07 mm/s resulted in ablation along a central section of the barrier wall, corresponding to the maxima of the Gaussian intensity profile of writing beam.

Figure 4:
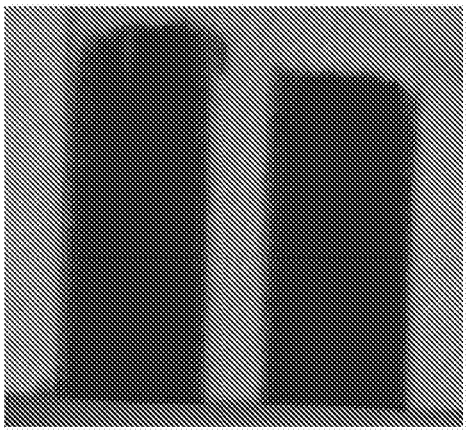

FIG. 4 shows a photograph of a paper substrate used in further experiments, having two channels with lengths of 20 mm, and fabricated under the conditions similar to those used to produce channel a in FIG. 3. The lines/walls were scanned or written with the paper substrate held at a distance of 10 mm from the focal point of the lens. The principle reason for employing this direct-write condition was that with a sufficiently lower incident average laser power (~7 mW), operation in this regime did not produce any ablation. Placing the paper substrate at a position that does not correspond to the smallest laser spot size, however, means comparatively smaller incident fluence when compared to the incident fluence at focus with a smaller laser writing spot. It was observed that to induce polymerisation over the entire thickness of the paper, the paper substrates had to be then translated at comparatively slower speeds. A consequence of slower scan speeds is longer device fabrication times, which may be an issue for industrial-scale manufacturing. Since the polymerisation depth of the laser-written structure is dependent on the incident fluence/energy density, an alternative which would increase the incident fluence/energy density without increasing the incident average power is to move the substrate closer to the focal point thereby ensuring a comparatively smaller laser spot size. The resulting higher fluence will then allow for polymerising structures at higher translational speeds. To investigate this, further experiments were done with the paper substrate held at a distance of 1 mm from the focal point, giving a corresponding laser spot dimension of ~0.1 mm×1 mm. By varying the substrate translational speeds it was possible to identify the optimal range of speeds that allows for producing barrier walls that extend through the full thickness of the paper. For this position, a scan speed of 0.25 mm/s was found to be necessary for this. Speeds ranging from 0.06 to 0.5 mm/s were tried, and it was found that speeds greater than 0.25 mm/s resulted in structures that did not extend throughout the paper, and speeds slower than 0.25 mm/s produced ablation along the central region of the scanned lines. Speeds less than 0.2 mm/s gave complete ablation of the paper, and hence a total detachment of the paper along the scanned line.

From the above results, it is clear that for a given paper type and thickness and a given light source and for a required writing line width, one can optimise the laser power, the light spot size, the paper-to-focal point separation and the scanning/writing speed to control the amount of energy delivered (fluence) to ensure that polymerisation occurs through the full thickness of the paper but without causing excess damage by ablation.

From the above, it is clear that variations in scanning speed and beam properties such as the dimension/size of the light beam incident onto the substrate surface (the scanned light spot) results in a variation of the sizes of the created solid features. This is useful aspect of the direct-write procedure according to the invention since it provides great flexibility for the range and type of features which can be written into a substrate. For example, variation of the laser spot size on the substrate surface allows control of the widths of the solid lines. Also, the amount of light energy which is delivered can affect the width of the lines, so provides a further control parameter. In the experiments described above in which the paper substrate was at a distance of 1 mm from the light beam focus, the widths of the barrier walls created in the paper were ~100 μm. These small barrier widths are nevertheless well able to contain and guide the fluid flow without leakage. For substrate to focus distances of 5 mm and 10 mm, barrier walls with widths of ~200 μm and ~300 μm were formed. It is expected that widths below 100 μm are achievable. Small barrier widths also allow the width of the channel to be reduced. Channel widths down to 180 μm have been created, but it is expected that narrower channels will be possible if required. This easily adjustable control over the feature width offered by the laser direct-write procedure of the invention is clearly advantageous, and offers a benefit not readily afforded by the prior art techniques such as lithography where feature size is fixed by the mask structure. The smallest usable feature size in a particular device will ultimately be determined by the end application for that device, but the small feature sizes achievable under the invention enable the fabrication of highly compact fluid-flow based diagnostic devices. Compact devices can operate with smaller volumes of expensive reagents and also have faster detection times, so a reduction in device size is a great advantage. For comparison, lithographic techniques can produce feature widths down to about 150 μm, and other prior art methods of making LOC fluid devices can only achieve larger sizes than this, so the present invention offers a significant improvement.

Since an important application of these fluid flow devices is in medical diagnostics, additional experiments have been carried out to further validate the guiding properties of the fluid channels and test their usefulness in fluidic diagnostic applications.

Figure 5:
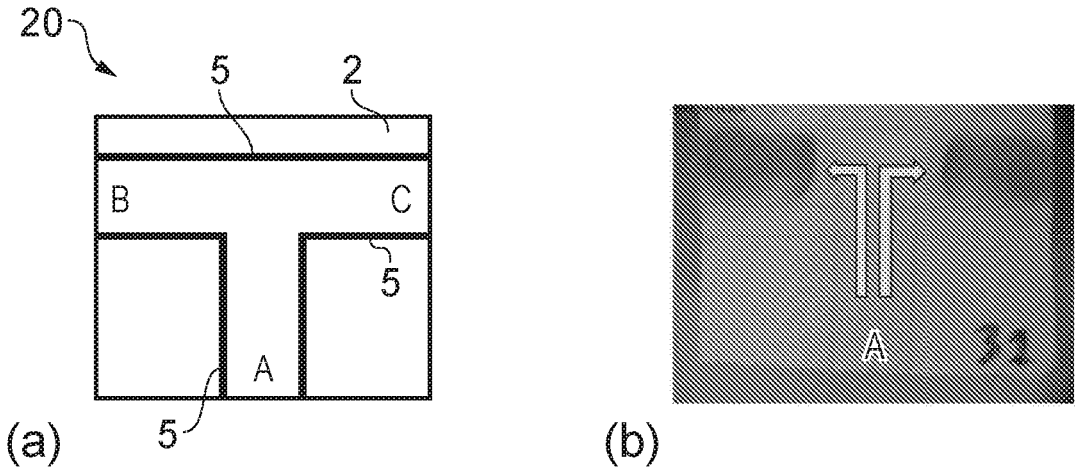
FIGS. 5(*a*) and 5(*b*) respectively show a schematic representation and a photographic image of a T-junction fluid flow device fabricated using a method in accordance with an embodiment of the invention.

FIG. 5(*a*) shows, as an example, a schematic diagram of a test device 20 fabricated according to an embodiment of the invention, using a photopolymer as the light-sensitive substance as described above. Barrier walls 5 were written into the paper substrate 2 to define a T-shaped channel network. A sample deposit site A was located at the base of the 'T' and two test sites B and C were located at each end of the arms of the 'T', the sites being in fluid connection along the defined channels. The channel width was 5 mm. To configure the device as a diagnostic test, enzyme conjugated antibody (HRP-conjugated IgG) was immobilised at the two test sites B and C. To test operation of the device, a quantity of the chromogenic substrate TMB corresponding to the antibody was introduced at the site A. The lateral flow characteristic of the channel network operated to successfully guide the TMB to the immobilised antibody at the sites B and C. Reaction between the antibody and the chromogenic substrate TMB results in the production of a blue colour, so that the occurrence of the interaction can be readily determined by observation. FIG. 5(*b*) shows a photograph of the device after the reaction, where the colour change can be seen as a dark staining of the paper substrate at B and C. Fluid flow from A to B and C is indicated with arrows. These results demonstrate that devices made according to the invention can successful function as diagnostic and other fluid test devices. A T-shaped channel as in this example could be used to perform two tests on the same fluid sample or analyte, by immobilising different reagents at the two test sites B and C.

Virtually any shape and size of channel or channel network can be written using the described method, to join any number of sites in fluid connection. Also, barrier walls in the substrate can be written in an intersecting arrangement such as a grid to form a plurality of individual cells in fluid isolation from each other, to form a paper version of a well plate or microtiter plate. Multiple testing on a single inexpensive disposable device is then possible, whereby each cell could be provided with a different reagent with small amounts of a single sample for testing then applied to each cell, or alternatively each cell could be provided with the same reagent, and different samples then applied to each cell.

Fluid Flow Delay and Control Structures

The inventors have recognised that the ability to produce solid (and potentially hydrophobic) features of variable depth in the substrate by varying the incident energy density or fluence (by varying the writing speed or laser power, for example) can be utilised to control the flow of fluid in the channels. This further increases the versatility of the invention; flow control has been difficult to implement with prior art techniques, whereas the invention offers a simple way to achieve this which can moreover be easily integrated into the channel fabrication process. The fast and flexible manufacture of microfluidic porous substrate devices with controlled fluid flow is hence offered. Furthermore, the formation of the flow control features can also be applied to pre-defined flow channel structures in a porous substrate, for example created by different techniques.

To control fluid flow, the inventors propose to use the laser direct-write technique to create one or more solid regions within a fluid channel which do not extend through the full thickness of the substrate and hence the full depth of the channel. These regions act as partial barriers to the fluid flow by partially blocking the channel and impeding the flow. The fluid flow past the point of the barrier is thereby reduced, and a delay is introduced in the fluid flow along the channel. This concept is analogous to the use of "speed bumps" to reduce road traffic speeds; drivers must slow down to safely negotiate the bumps, and a larger number of bumps or a higher bump will further reduce the time taken to travel along the road.

Figure 6:
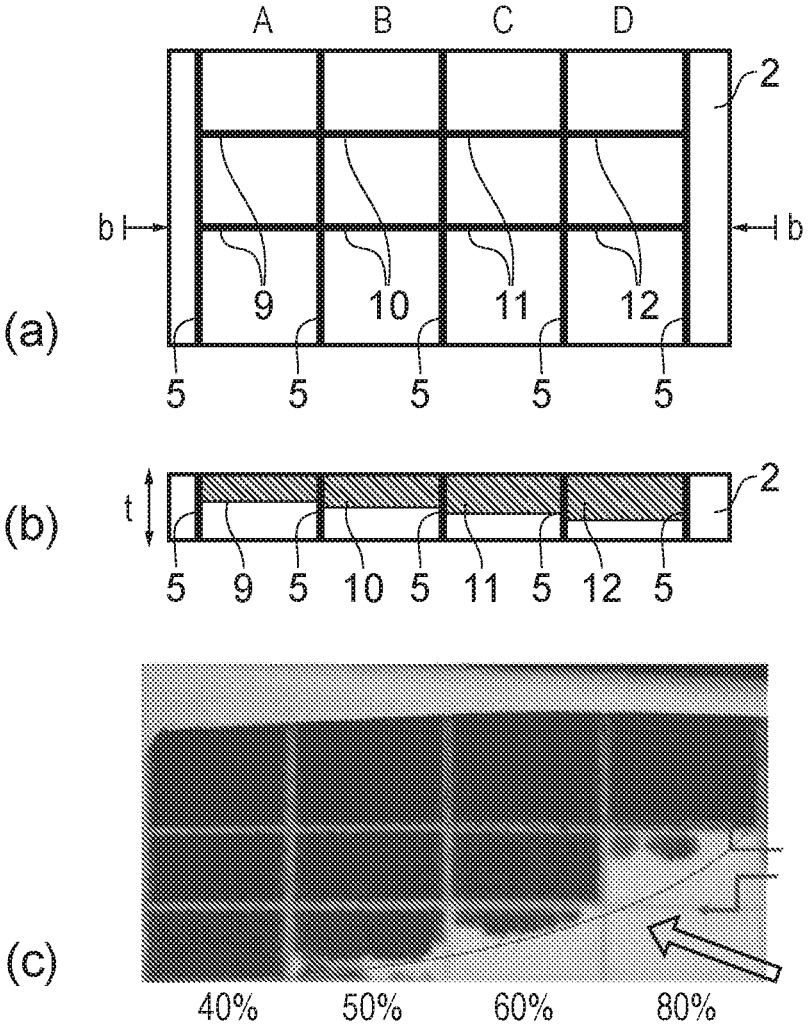
FIGS. 6(*a*), 6(*b*) and 6(*c*) respectively show a schematic plan view, a schematic cross-sectional view and a photographic image of a fluid flow device fabricated using a method according to an embodiment of the invention.

FIG. 6(*a*) shows a schematic representation of a device fabricated to test and demonstrate this theory. In a substrate 2, five parallel spaced-apart identical barrier walls 5 were laser-written through the full thickness of the substrate using a photopolymer as the light-sensitive substance, to define four channels A, B, C, D, one channel between each pair of adjacent walls. Then, lines orthogonal to the barrier walls were laser-written across the width of each channel, to create partial barriers. Two lines were made for each channel, both written with the same writing conditions. However, the writing conditions were varied for each channel. The same incident average power for the laser beam was used for all the lines, but the lines for each channel were written at different speeds, thereby delivering different incident energy densities to create polymerised features of different depth. The writing speed was reduced from channel A across to channel D, to give partial barriers increasing in size from channel A to channel D. Specifically, the partial barriers 9 in channel A were written at 0.5 mm/s, giving a partial barrier depth of ~40% of substrate thickness, the barriers 10 in channel B were written at 0.25 mm/s to give a partial barrier depth of ~50% of substrate thickness, the barriers 11 in channel C were written at 0.1 mm/s to give a partial barrier thickness of ~60% of substrate thickness, and the barriers 12 in channel D were written at 0.07 mm/s to give a partial barrier thickness of ~80% substrate thickness. As mentioned above, like speed-bumps across a road, the partial barriers across the fluid channels perform the function of slowing down or completely stopping the flow of fluid though the channel. The extent to which fluid flow can be delayed (or completely stopped) depends on the depth of these barriers compared to the channel depth/thickness and also on the number of barriers that are patterned into the channel. Greater barrier depths will result in greater delay, and similarly, the greater the number of barriers in a channel, the longer is the delay.

FIG. 6(*b*) shows a schematic cross-sectional view through the substrate 2, along one of the lines of partial barriers (indicated as line b in FIG. 6(*a*)). The barrier walls 5 between each channel extend the full thickness t of the substrate 2. The partial barriers 9, 10, 11 and 12 extend only part of the way through the substrate, however, as shown by the shaded areas. The depths of the partial barriers vary across the substrate according to the data presented in the previous paragraph. Thus, channel A has a shallower partial barrier than channel D. Note that because the substrate 2 is exposed to the laser energy from above (according to the orientation in the diagram; the substrate could naturally be inverted after fabrication of the barriers), the polymerisation forms from the top surface downwards, and the fluid channels are left open at the bottom of the substrate so that the fluid flows under the obstacles presented by the partial barriers 9, 10, 11, 12.

FIG. 6(*c*) shows a photographic image of the substrate after a coloured ink was introduced at the top end (as seen in the image) of each of the four channels and allowed to flow therealong. As expected from the different sizes of partial barrier (the percentage depths of which are shown under the image), the flow of the ink along each channel was different, with channel D having the slowest flow (caused by the deepest partial barriers) and channel A having the fastest flow. The image in FIG. 6(*c*) was taken 3.5 minutes after the introduction of the ink into the channels. As can be seen, at this time the ink has flowed along the entire length of channel A, is approaching the end of channel B, has flowed past the second partial barrier in channel C, but has only just flowed past the first partial barrier in channel D. Hence, the function of partial barriers in delaying fluid flow is clearly demonstrated, with the effect of different partial barrier depth in adjusting the rate of flow being evident.

It is anticipated that this time-delayed fluid flow could be implemented in conjunction with specially-designed and potentially highly complex device channel geometries to enable enhanced device functionalities.

Figure 7:
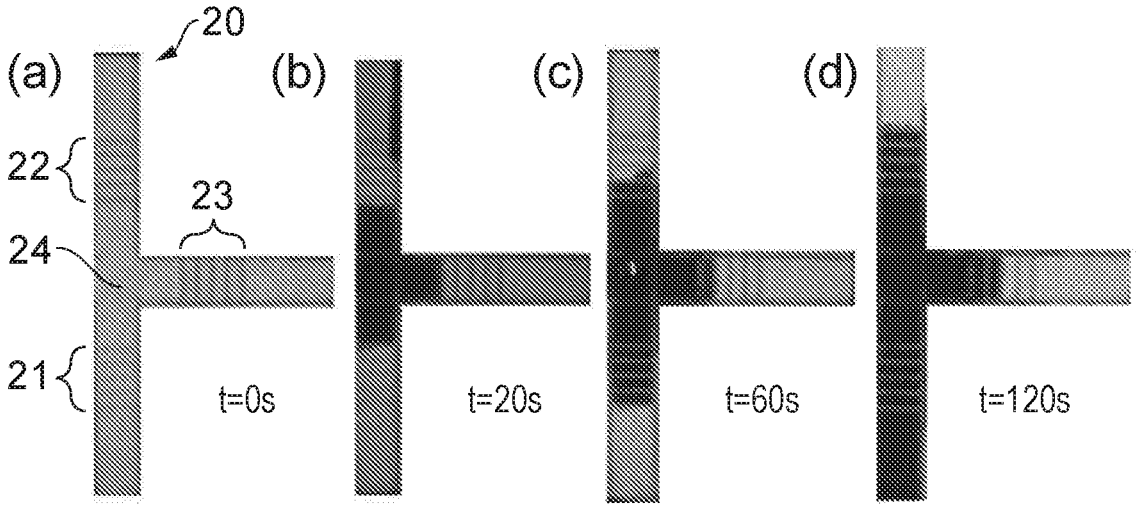
FIGS. 7(*a*), 7(*b*), 7(*c*) and 7(*d*) show a sequence of photographic images of a fluid flow device fabricated using a method according to an embodiment of the invention, during use.

FIG. 7 shows photographic images of an example device of this type. The above-described methods of laser-patterning with a photopolymer were used to create a T-junction channel structure 20 having three arms of identical length.

For each arm, the walls were created to extend throughout the entire thickness of the paper substrate to define a structure able to contain and guide the flow of fluid along it. Then, five fluid-delaying partial barriers 21, 22, 23 were laser-patterned across each of the three arms of the T-junction. To preserve the symmetry of the T-junction, the barriers for each of the arms were patterned at the same distance along the length of each arm. Within each arm the barriers were written to extend through the same depth through the substrate, but this depth was different for each arm to introduce a different flow delay time into each arm. The depth of the barriers 21 in a first of the arms was ~50% of the substrate thickness, in a second arm the depth of the barriers 22 was ~60% of the substrate thickness, and in the third arm the barriers 23 had a depth of ~70% of the substrate thickness. Hence, the fluid flow was expected to be fastest in the first arm and slowest in the third arm. FIG. 7(*a*) shows this channel structure 20 as fabricated and before use. Then, a blue-coloured ink was introduced at the junction point 24 of the structure 20, from which the ink would flow along each arm. FIGS. 7(*b*), (*c*) and (*d*) show the flow of ink 20 seconds, 60 seconds and 120 seconds after introduction respectively. FIG. 7(*b*) shows that the flow is roughly the same in each arm and has reached the location of the first partial barrier in each arm. For later times, the partial barriers have acted to delay the flow by different amounts in each arm, so that by 120 seconds after introduction, ink has flowed past the barriers 21 and along the entire length of the first arm, has just flowed past the fifth and final barrier 22 in the second arm, but has reached only the third barrier in the third arm 3. In this manner, a time-controlled sequence of tests could be performed by placing a different reagent at the end of each arm, which would react in turn with an analyte introduced at the junction. Additional arms could be added as required. An alternative delay mechanism could be implemented by using a different number of barriers in each arm.

Figure 8:
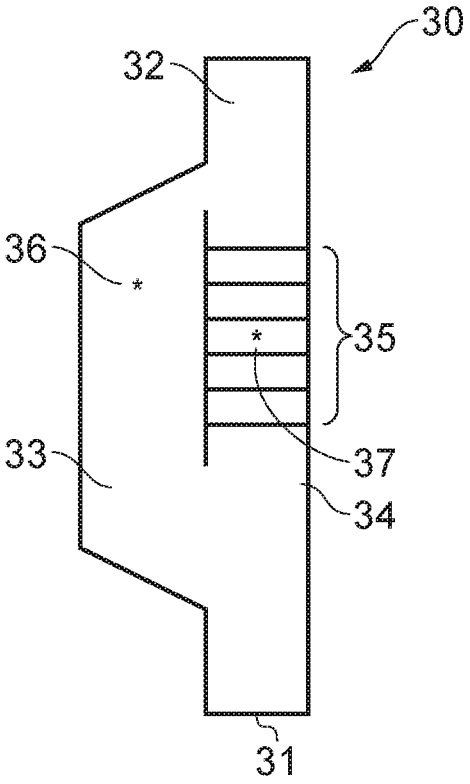
FIG. 8 shows a schematic representation of an example fluid flow device with fluid delay barriers that may be fabricated using methods according to the invention.

FIG. 8 shows a schematic representation of an alternative channel structure suitable for performing sequential tests or reactions. The structure 30 is comprised of two parallel channels with common shared ends and both running between an analyte introduction site 31 and a test zone or site 32 at those ends. One channel 33 is a non-delaying channel with no partial barriers, and the other channel 34 is a delaying channel 34 with a series of partial barriers 35 written across it. The quantity and depth of barriers 35 can be varied to introduce a required delay time, so that fluid introduced at the site 31 and flowing in the delaying channel 34 will reach the test zone 32 a desired time after that part of the fluid that takes the non-delaying channel 33. A reagent can be embedded within each channel as required, for example at the positions 36 and 37, with a different reagent for each channel. The fluid that has interacted with the different reagents then comes together again at the test site 32.

Microfluidic controllable/programmable time-delayed fluid-flow mechanisms and structures achieved by other means are known. A delay in the fluid flow has been achieved through use of dissolvable materials such as sugar [21], wax and pullulan introduced in the path of the fluid flow, or through the use of channels with fluid delaying structures such as convoluted serpentine paths [19]. Fluid-delay mechanisms are essential for developing paper-based diagnostic tests that are not limited to single-step chemistries, for example to replace or improve the commonly used diagnostics detection test ELISA (enzyme-linked immunosorbent assays) which has to be performed in controlled laboratory environments with a protocol that requires a machine or skilled personnel to perform sequential multiple discrete steps at specific time intervals. The present invention allows a single laser-patterning procedure to be used to pattern a porous substrate with both fluid-flow structures (channels) and fluid-delay structures (partial barriers within the channels), so offers a simple and attractive method for fabricating a range of versatile microfluidic structures, such as would be useful for implementing lateral flow-type multi-step ELISA tests through a single sample application step, thereby allowing point-of-care detection with minimal user intervention.

The partial barriers described so far were fabricated so as to have a substantially equal depth at all points across the width and length of the barrier. This is achieved by applying equal laser energy over the area of the barrier on the substrate surface, for example by keeping the light beam speed and/or the laser power (depending on the variable chosen to control the depth of the barrier) constant for the time of writing the barrier. However, further control over the flow can be implemented by varying the barrier depth across an individual barrier, along the direction of fluid flow.

Figure 9:
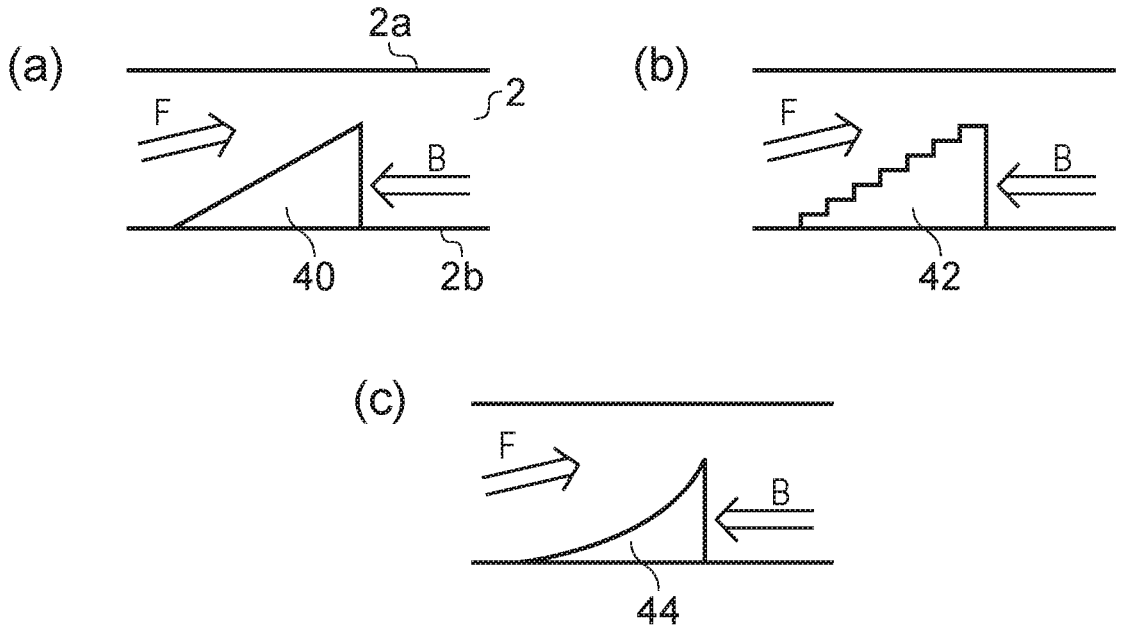
FIGS. 9(*a*), 9(*b*) and 9(*c*) show schematic cross-sectional views through a fluid flow channel in a device having partial barriers fabricated according to embodiments of the invention.

FIG. 9 shows schematic cross-sectional representations of substrates having a flow channel with examples of partial barriers of this type formed within it. The cross-sectional views are though the longitudinal, fluid flow, direction of the channel. The substrate 2 has an upper surface 2*a* and a lower surface 2*b*. Within a fluid channel, laser writing is used to define a partial barrier having a variable depth. Considering fabrication under the negative regime wherein the laser-exposed regions are retained as solid features, as illustrated, the lower surface 2*b* of the substrate 2 has been exposed to the laser light. In FIG. 9(*a*), the partial barrier 40 has a profile in the fluid flow direction such that its depth (or height) increases linearly. In use, the partial barrier 40 presents a different obstacle to fluid flowing in the channel depending on flow direction. Fluid flowing in a forward direction F meets a slowly increasing barrier height and is able to flow up and over the barrier. Fluid flowing in the reverse, backwards, direction B meets an abrupt perpendicular barrier and is impeded much more than the forwardly flowing fluid. The barrier 40 is hence able to operate to produce one-directional, non-reciprocal flow in the forwards direction F; fluid can be inhibited from flowing in the backwards direction. Depending on the height/depth of the barrier, the backwards flow can be almost or completely stopped, or merely reduced in speed compared to the forward direction. Other barrier shapes can be used to produce the same or a similar effect, with the shape chosen and tailored to balance the speed of the two flow directions against each other as required. For example, FIG. 9(*b*) shows a partial barrier with a stepped profile, and FIG. 9(*c*) shows a partial barrier with a smooth non-linear profile. Partial barriers with a varying depth profile can be used to produce complex flow patterns within a network of connected channels. In a structure embedded with multiple reagents, they could be used to prevent fluid that has interacted with a reagent in one channel from entering a second channel with a second reagent so that multiple or sequential tests are not disrupted.

Figure 10:
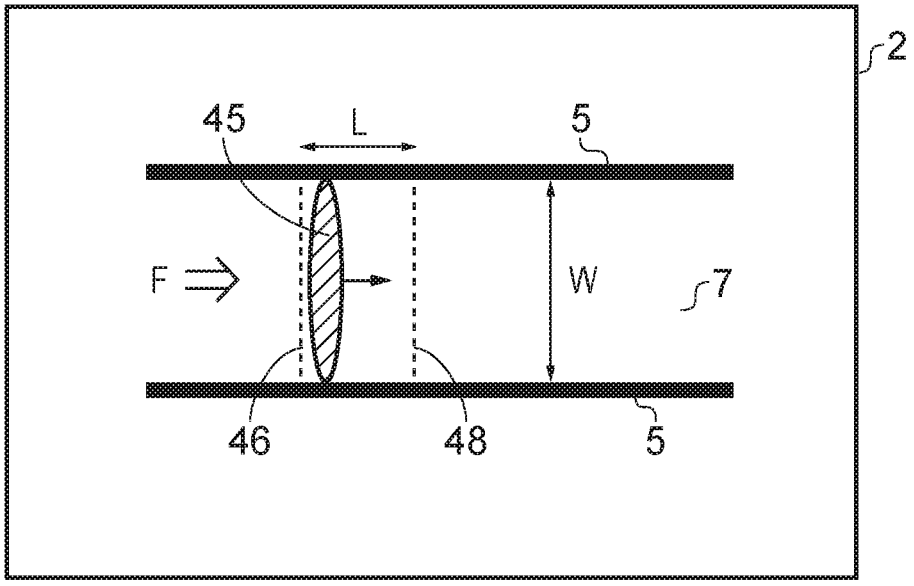
FIG. 10 shows a schematic plan view of a substrate having a partial barrier created therein using a method according to an embodiment of the invention.

FIG. 10 shows a schematic depiction of a method for writing a barrier of varying depth, in plan view. A substrate 2 has a pair of barrier walls 5 formed within it to define a fluid flow channel 7, in which it is intended that fluid should flow in a forward direction F. A barrier of increasing depth is required across the channel 7, extending from a first location 46 along the channel length to a second location 48 along the channel length to give a barrier length L. To achieve this, under the negative regime a writing light beam is focussed or imaged to produce a spot size 45 that extends across the width W of the channel. This is directed on the substrate surface between the channel barriers 5 at the first location 46, and scanned in the direction of the arrow until it reaches the second location 48. During scanning, the energy per area delivered by the laser light is increased, so that an increasing depth of light-sensitive substance is changed to the second state, which in this example is the solid developer-resistant state. This can be achieved, for example, by decreasing the scan speed, or increasing the laser power, or both, over the time of the scan. Thus, the barrier depth is less at the first location 46 than at the second location 48, and fluid flow is enabled in the forward direction F and stopped in the opposite direction. Of course, the barrier could be formed by scanning in the opposite direction, from location 48 to location 46, while reducing the laser energy. The laser energy can be varied in a linear, non-linear or step-wise manner to produce the required barrier profile. Depending on channel width, it may be preferred to use a spot size 45 less than the channel width W and build up the barrier by writing several adjacent lines. As a further alternative, a single light spot of substantially the same area as the required barrier might be used to create the barrier without scanning, by exposing the substrate to the light spot through a mask or filter which produces a light intensity at the substrate surface that varies across the width of the spot. Other techniques to vary the fluence over the area of the substrate which is exposed to write the barrier will be apparent to the skilled person.

Varying depth partial barriers with a profile which is vertical on one side and sloped or stepped on the other side have been described thus far, but the invention is not limited to barriers of this shape. Other varying depth profiles can be created as required to provide specific flow control or delay, for example, a slope on each side of the barrier where the two slopes are the same or different, or a slope on one side and steps on the other side. Profiles can be curved (concave or convex) or straight or a combination of both. Creation of any barrier depth profile is achievable simply by adjusting and controlling the laser fluence during the writing process so that the required alteration of the light-sensitive substance into the second state occurs over the depth required at each point in the profile.

Combining Barriers and Channels

As mentioned, the present invention provides as attractively simple way to create flow control barriers within fluid flow channels in a porous substrate by writing both the channels and the barriers with the same technique, in a single fabrication stage. Rapid yet flexible fabrication of microfluidic devices can hence be achieved. Parameters such as laser power, light spot scanning speed and direction, light spot size and substrate scanning speed and direction can be readily and quickly adjusted, and automated. Thus, methods of the present invention are well-suited to both mass production and small production runs, plus individual production of prototypes and made-to-order production for individual customer requirements. However, the barrier fabrication can also be combined with existing techniques for making flow channels if desired, so that a substrate with pre-formed channels can then be provided with partial barriers for fluid flow control using embodiments of the invention.

Device Types and Configurations

Clearly, a wide range and variety of flow devices and structures on porous substrates can be fabricated using the methods described herein. Any number of sample or analyte introduction locations can be connected to any number of test zones or locations via any number, shape and pattern of flow channels. Partial barriers can be added to any or all of the channels to control flow within the channels, where the barriers may have a substantially constant thickness to reduce fluid speed, or may have a thickness variation along the flow direction to produce one-direction flow. Varying depth barrier profiles can also be used for delay alone. Isolated cells for fluid containment may also be included. Channel, cell and barrier layouts are not limited to those examples illustrated and described herein.

Devices may be extended from two-dimensional flow networks. For example, by forming a particular structure in a paper (or other porous) substrate, it is possible to make a three-dimensional network by then folding the paper along pre-defined fold lines. The folds will bring various parts of the structure into juxtaposition, and new channels can be formed across the layers of paper since fluid can soak or wick from one layer into the next layer within the boundaries set by the barrier walls. The intended fold lines may be marked onto the substrate surface, perhaps by printing, to facilitate the folding. This allows more complex microfluidic networks to be created, and also facilitates distribution of complex devices in a simple manner, since substrates can be delivered unfolded, then folded for use by the end user.

Also, an important feature of the invention to note is that it enables the formation of fluid flow structures within and throughout the thickness of the substrate. This can also be considered as a three-dimensional structure, even when limited to a single thickness of substrate. This is an advantage over known fluidic device fabrication techniques which can form fluid channels only on the surface of a substrate, with no capability to extend the network in a third dimension. The present invention allows the formation of solid structures to be controlled in each of the X, Y and Z dimensions, where Z is the substrate thickness direction, thereby facilitating complex three-dimensional fluid flow networks to be fabricated if required.

A colour change caused by the reaction between analyte and reagent at a test site on a device can be employed to encode the result of the test such that it can be read automatically, or only understood by a healthcare professional. For example, the substrate may be printed with a one- or two-dimensional pattern similar to a bar code or a QR code. A colour-change reagent may be embedded at one or more locations within the pattern in a colourless manner; these are connected to an analyte introduction site elsewhere on the substrate by one or more channels. Analyte introduced onto the substrate will flow to the test location(s), and possibly cause a colour change at the location(s) depending on a positive or negative test. The colour change will alter the shape of the pattern, which can then be read by a hand-held scanner or photographed by a mobile telephone or tablet camera for communication to a remote diagnostic facility or website, and interpreted accordingly. Other information, such as type of test, and patient identity, could be encoded in the test pattern also, to further facilitate automated testing.

Fluid flow devices according to embodiments of the invention are not limited to medical applications such as diagnostics. Biological and chemical sensors in lateral flow test formats for sample testing are also required in fields including veterinary medicine, the food, beverage, water and pharmaceutical industries, agriculture, and environmental sensing. The invention can provide devices for use in all of these fields, and any other requiring fluid sample testing.

Substrates

A variety of materials may be employed as a substrate for the present invention. Paper has been found to be of particular interest, since it is readily available in a range of thicknesses, densities, porosities and colours, is inexpensive, can be easily cut to size, can be printed with instructions, directions and indicia, can be folded, and is lightweight. However, other porous materials may be used instead, such as cardboard, or woven and non-woven fabrics made from natural or synthetic fibres and combinations thereof. Fabric substrates offer potential for smart fabrics and wearable diagnostic devices. Other examples of substrates may include sintered materials such as sintered glass or sintered plastics.

In some examples, the substrate material may have wicking ability such that a fluid is drawn along a channel in the required fluid flow, for it to retain the light-sensitive substance in the impregnation stage, for it to be able to withstand exposure to the required laser energy density without suffering unacceptable ablation or other damage, and for it to be able to undergo the development step. A material which displays these characteristics may be used as the substrate in the present invention. The properties and characteristics of potential substrate materials can be compared when selecting a potential substrate for a particular device. A property of particular interest is the density of the material as expressed through its internal structure, since this will affect the size of the solid structures which may be written into it. A material with an open structure (such a large-grained paper with wide grain spacing) may have a minimum barrier width that is able to fully contain fluid within a channel, so that thinner structures cannot be used on such a substrate. This may affect the overall minimum device size which is achievable.

Typically, the substrate will be planar, such as a sheet or layer of material, but this is not essential, particularly if the fabrication technique uses the positive regime mentioned above and described further later, in which a channel can be formed which does not have to extend through the full thickness of the substrate.

Hence, some substrate materials may have wicking ability, which can be useful because this allows a fluid to be drawn along a channel in the required fluid flow and the radiation-sensitive substance can be drawn down through the substrate thickness in the deposition stage.

Other materials may not have an inherent wicking ability, and instead the fluid flow may be controlled by the application of an external factor, such as an electric field or exposure to radiation. This can be useful for example because the fluid flow device may take a fluid sample at the point of care, but then may need to be inserted into a device reader or other apparatus in order to carry out the actual analysis of the sample. If there is a delay in transferring the device to the reader, then if the fluid naturally flows through the substrate, by the time the device reaches the reader the fluid may already have flowed through the fluid flow network and out of the device preventing appropriate analysis. This problem can be avoided if the fluid does not naturally flow through the substrate unless an external factor is applied.

For example, if the fluid is an ionic fluid, an electric field could be applied by the reader to trigger the flow of fluid.

Alternatively, if the fluid is not itself ionic, flow of fluid may be controlled by varying the wetting properties of the structures in the fluid flow network. For example, the wetting properties (e.g. hydrophobicity) of some materials may change when an electric field is applied or when electromagnetic radiation is applied. Such a material may be injected to coat the insides of the structures formed by the method above, so that they retain the fluid in an initial state and become more hydrophobic on application of the electric field or exposure to electromagnetic radiation, so that fluid starts to flow.

In some examples, different types of substrates can be joined to form a composite substrate, and then form the structures on the composite substrate using the method described above. This can be useful for providing different fluid flow rates in different parts of the composite substrate, for example.

Nitrocellulose Substrates

Another substrate material of special interest is nitrocellulose, such as in a sheet or membrane format. Nitrocellulose membranes have particular application in point-of-care biosensor devices (such as pregnancy tests) since the material has a range of advantages. It has a high binding affinity for proteins, it produces only a low background signal, and is compatible with a variety of detection methods including chemiluminescent, chromogenic and fluorescent techniques. Also, the manufacture of nitrocellulose, which is well-established at the industrial scale, can be controlled to produce pores of specific sizes which are large enough to allow lateral fluid flow, as required by the present invention.

Accordingly, embodiments of the invention employ nitrocellulose as the porous substrate material. Fluid channels and flow control structures and barriers have been fabricated in nitrocellulose substrates with a high level of repeatability.

The different nature of nitrocellulose as compared to paper means that different light-sensitive substances and solvents may be required. Various photopolymers have been investigated to find a suitable candidate. Many photopolymers react with nitrocellulose to plasticize it to an unacceptably hydrophobic material unsuitable for implementing the invention. However, the high index fibre polymer sold as DeSolite (registered trade mark) 3471-3-14 (from DSM Desotech Inc.) has been found suitable for use with nitrocellulose substrates. Other photopolymers and light-sensitive substances may also be appropriate in this regard.

Testing of solvents was also carried out to identify a solvent suitable for use with nitrocellulose and with the identified photopolymer. Not all solvents are suitable. For example, acetone dissolves nitrocellulose, and IPA (isopropyl alcohol) plasticizes nitrocellulose into a very hydrophobic material. Toluene was found to be compatible with nitrocellulose substrate material, however, and suitable for removing the photopolymer not converted to the solid state by the light exposure.

The DeSolite (registered trade mark) 3471-3-14 photopolymer has a high viscosity (10,000 mPa·s at 25° C.) so in initial experiments it was diluted with the toluene solvent at a ratio of 5:3. The nitrocellulose substrate was impregnated by soaking it in the diluted photopolymer; it was then allowed to dry under ambient laboratory conditions.

For the light exposure step, parallel lines were written into the substrate by scanning a focussed beam of laser light over the substrate surface, with adjacent parallel lines forming walls through the substrate to define fluid flow channels as already described. Laser powers of 50 mW and 100 mW were used with a scanning speed of 10 mm/s. After laser exposure, the substrate was developed in the toluene solvent to remove the unpolymerised photopolymer in the unexposed areas.

Figure 11:
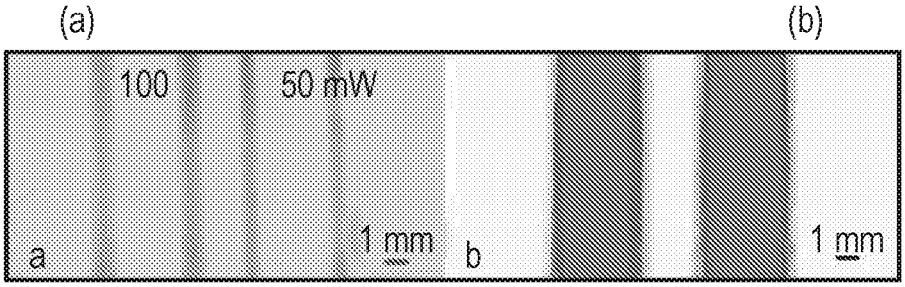
FIGS. 11, 12 and 13 show photographic images of fluid flow devices fabricated from nitrocellulose substrates using methods according to embodiments of the invention and FIGS. 14(*a*), 14(*b*), 14(*c*) and 14(*d*) respectively show a schematic plan view and three schematic cross-sectional views of a substrate with a fluid flow channel and two partial barriers fabricated according to an embodiment of the invention.

FIG. 11(*a*) shows a photograph of a nitrocellulose substrate processed in this way. The parallel lines defining the channels can be seen. The ability of the walls to retain and direct fluid flow was tested by applying ink to a channel, as shown in the photograph of FIG. 11(*b*). FIGS. 11(*c*)-(*f*) show successive photographs of the ink flow, and demonstrate good confinement of the ink within the channel, with no leakage through the barrier walls.

It was found, though, that the concentration of the photopolymer diluted in the toluene is difficult to control, owing to the high volatility of toluene under ambient laboratory conditions. As long as the diluted photopolymer is exposed to air, the toluene evaporates at a high rate, causing an unknown change in the concentration. The width of the features produced in the substrate by the polymerisation depends on the concentration of the polymer, so this issue makes it difficult to create features of a predictable and consistent size.

To address this, further experiments were conducted using undiluted photopolymer. A longer soaking time of the substrate in the photopolymer is needed for impregnation, owing to the high viscosity; several minutes were found to give full absorption of the photopolymer into the substrate. Conveniently, the high refractive index of DeSolite (registered trade mark) 3471-3-14 causes the nitrocellulose substrate to become transparent so the level of impregnation can be readily monitored by observing the transparency of the substrate.

Figure 12:
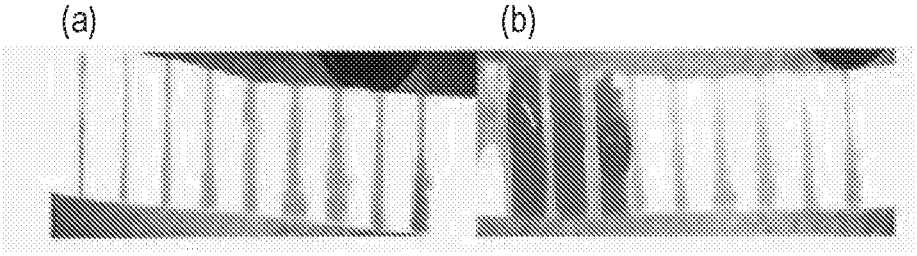

FIG. 12 shows photographs of a substrate treated in this way with parallel lines written by laser exposure to form solid barrier walls. A laser power of 100 mW was used to write lines at different scanning speeds (10, 5, 1, 0.5, 0.5, and 0.05 mm/s). The lines written at the faster speeds are shown on the left of FIG. 11(*a*) and the lines written at the slower speeds are shown in the right. The photopolymer material remains transparent after polymerisation and development in the toluene solvent. The lines written at speeds below 5 mm/s are less clearly defined, having ragged edge areas owing to over-polymerisation produced by the greater laser fluence. The lines written at the faster speeds of 5 mm/s and above are neatly defined, however, and contain and guide fluid flow, as shown by the ink in the three left-most channels in FIG. 12(*b*).

In order to investigate optimum conditions for patterning in the nitrocellulose substrate, further experiments were carried out by writing lines at a constant scanning speed of 10 mm/s but different laser powers.

Figure 13:
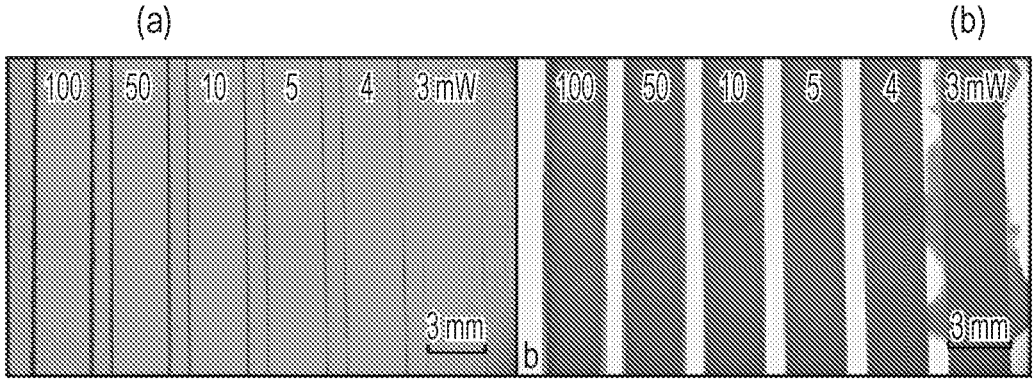

FIG. 13 shows photographs of substrates resulting from these experiments. In FIG. 13(*a*), lines can be seen which were written at speeds of (from left to right)) 100, 70, 50, 30, 10, 5, 3 and 1 mW, followed by two channels formed by pairs of lines written at 70 mW (left) and 100 mW (right). FIG. 13(*b*) shows the same substrate with ink applied to demonstrate fluid containment and flow. From this experiment, one learns that for a scanning speed of 10 mm/s discernable barrier features providing at least some degree of fluid confinement can be written at laser powers down to only 3 mW. FIG. 13(*c*) shows a second substrate having lines written at (from left to right) 100, 70, 50, 30, 10, 5, 4, 3, 2, 1 mW and two channels formed by pairs of lines written at 5 mW and 4 mW. Ink applied to the channels has been confined without leakage even for the channel walls written at 4 mW of laser power. Thus, it is not necessary to employ high levels of laser fluence when exposing a nitrocellulose substrate under the described conditions, indicating that fluid flow devices could be fabricated efficiently.

It was also found that the toluene developer renders a nitrocellulose substrate slightly more hydrophobic, although the level was low enough not to create any observable problems with fluid application, flow and delivery. To address this, though, a washing stage could be applied to remove residual developer solvent from the substrate.

Although the experiments depicted show barrier wall formation, partial barriers as described above may also be created in nitrocellulose substrates. Indeed, all aspects of the invention described with reference to paper substrates are equally applicable to nitrocellulose substrates, and to substrates made from other porous materials.

Light Sources

Lasers provide convenient sources of light for the present invention, since their beams can focussed to a small spot size, a range of wavelengths are available, power can be easily adjusted, and beam scanning is readily implementable. Electromagnetic radiation of any desired wavelength may be used. Preferred forms of radiation include ultraviolet radiation (typically defined as electromagnetic radiation having a wavelength of 20 to 400 nm) and visible light (typically defined as electromagnetic radiation having a wavelength of 400 to 700 nm). However, other light sources may be used if preferred. For example, the light source may be a supercontinuum source, one or more light emitting diodes, or other source which is sufficiently bright and of the proper wavelength to produce the required transformation of the light-sensitive substance from the first state to the second state. The light source will be selected also according to the wavelength emitted, having regard to the wavelength or wavelength range to which the particular light-sensitive substance is reactive.

The light spot as exposed onto the surface of the substrate can be produced by any arrangement which gives a spot of sufficient intensity and energy density to induce the state change in the light-sensitive substance. Often, this will be an arrangement such as focussing or imaging of the incident light beam which substantially reduces the spot size (while giving a spot of the required dimension for the structure to be written) so as to give a significant increase in the local intensity and energy density of the beam. The light beam will generally be exposed directly onto the substrate surface to define the writing spot on the substrate surface, subject to any lenses, mirrors and the like used to form, shape and direct the light beam into the required spot size and shape. "Directly" indicates that there is no intervening mask or similar, such as is required in lithographic techniques.

The light source may provide a continuous emission of light or a pulsed emission, for example a laser source that produces pulses with durations on the nanosecond, picosecond or femtosecond scale. The terms "light beam", "beam", and "beam of light" are used in the context of the present invention to include both the continuous and pulsed alternatives.

Other sources of radiation may include ion beams, electron beams, and ultrasound, for example, which may be used to convert a radiation-sensitive substance from the first state to the second state.

It is also possible to apply more than one source of radiation to the same device. For example, sources of radiation of different types may be provided (e.g. ambient light and laser light, or ion beam radiation and laser light). Also, the different sources of radiation could provide radiation of different wavelengths, frequencies or energy density, for example. This can be used to provide further control of the formation of structures in the device. For example, the different sources may provide different depths or degrees of conversion of the radiation-sensitive substance from the first state to the second state, which can provide structures with different permeability to the fluid. For example, one source of radiation (e.g. a first laser) could be used to form walls and another source (e.g. a laser of different frequency or energy) could form barriers. In another example, the different types of radiation could for example correspond to different types of laser such as a pulsed laser and a continuous wave laser (for example pulsed and continuous wave lasers can be used to form different kinds of barrier).

In some cases, the different sources of incident radiation may be applied in series so that a first source is applied initially, and later a second source is applied.

It is also possible to use simultaneous sources of radiation in parallel, so that multiple structures or barriers can be created at the same time. For example, a beam of radiation could be split into multiple beams each of which may be used to write a line, wall or barrier.

Positive and Negative Fabrication Regimes

As mentioned earlier, the processes of the invention may utilise either a negative or a positive regime, depending on the nature of the light-sensitive substance chosen. Most of the examples presented thus far have been in the negative regime. In the negative regime, a light sensitive substance (such as a photopolymer or a negative photoresist) is selected such that the substrate parts exposed to the light energy are transformed into the desired solid structures, and the subsequent development of the substrate removes the unexposed light-sensitive substance. Hence, the light exposure defines or "writes" the solid structures. To create a fluid channel, it is necessary to write a wall for each side of the channel; the walls are solid structures which extend the full thickness of the substrate and confine the fluid within the channel. Thus, two laser lines must be written to form one channel. To create a partial barrier, the light-sensitive substance in the substrate volume required to become the barrier is changed to its second state by exposing the substrate surface above the volume to the appropriate laser fluence.

It is also possible to employ an opposite, positive process. In the positive regime, a light-sensitive substance such as a positive photoresist is chosen which itself is or can be made solid before the light writing stage, so that it is in a first state which is solid and developer-resistant. The light-sensitive substance in the parts of the substrate which are then exposed to the light energy is changed into a second state which is able to be removed by a developer solvent, and the development then removes this material to restore the substrate material in those regions to its original condition. The non-exposed parts retain the light-sensitive substance in its first state and hence form the solid structures. Thus, the light exposure defines or writes the hydrophilic parts of the substrate formed from untreated substrate material, where fluid flow is permissible. The light beam is used to "carve out" hydrophilic spaces for fluid flow in a solid substrate. To create a fluid channel it is merely necessary to write a single line of the same width as the desired channel. After development, this exposed region will be hydrophilic, and the light sensitive substance in its solid first state will still be impregnated throughout the surrounding substrate material. Hence, a positive regime might be preferred, since the time to create a flow channel is effectively half that of the negative regime.

Also, under the positive regime, a flow channel need not extend through the full thickness of the substrate. Rather, one can think of the light beam carving a groove for the fluid from the solid substrate, with some solid material left below the exposed hydrophilic volume. The depth of the induced state change will depend on the energy fluence delivered, in the same manner as in the negative regime, so one can select the channel depth by adjusting the fluence (by controlling writing speed and/or laser power as before). One can think of this as a three-dimensional device, since two or more flow channels can be written with different depths in the same substrate, or an individual flow channel can be written with a depth that varies along its length. Great flexibility in device design and fabrication is thereby available. This aspect of flow channel formation in a porous substrate is not possible via known fabrication techniques.

A partial barrier can be formed in the same way in the positive regime as in the negative regime, by exposing an area of the substrate to an amount of fluence that will cause a change to the second state through only part of the substrate (or channel) depth or thickness. However, for the positive regime, one needs to deliver light energy to the volume of material which will not form the barrier. This is the reverse of the negative regime, where the volume intended for the barrier is altered by light exposure. So, in the positive regime, a deep barrier that slows the fluid flow a lot will be formed by a small amount of light exposure, whereas a shallow barrier will be formed by a large amount of light exposure. A varied depth barrier for one-way directional flow control will be formed by varying the fluence over the barrier extent, as for the negative regime, but with the variation in the opposite direction. Hence, when scanning the writing spot along the barrier extent in the desired direction of fluid flow (from the shallow end to the deep end of the barrier), the fluence is reduced, for example by reducing the laser power or increasing the scanning speed.

In the positive regime, it is possible to write a channel together with one or more partial barriers within it from one single laser writing line, merely by altering the laser energy delivered at the appropriate locations. The channel is written by exposing a line on the surface of the substrate that has the desired channel width to a fluence sufficient to induce the state change in the light-sensitive substance to the required depth for the channel (which may or may not be the full thickness of the substrate). At each location where a partial barrier is required, the fluence is reduced so that a shallower depth of state change is produced. Development of the substrate removes the material that has been changed to the second state to restore the original hydrophilic substrate material in those regions, leaving the solid light-sensitive substance elsewhere. The hydrophilic region is the groove of the channel, with solid structures in its base at those places where the fluence was reduced. Again, therefore, device fabrication can be faster using the positive regime. Also, as with the negative technique, the positive technique can be used to create partial barriers within one or more fluid channels already defined in a substrate.

Figure 14:
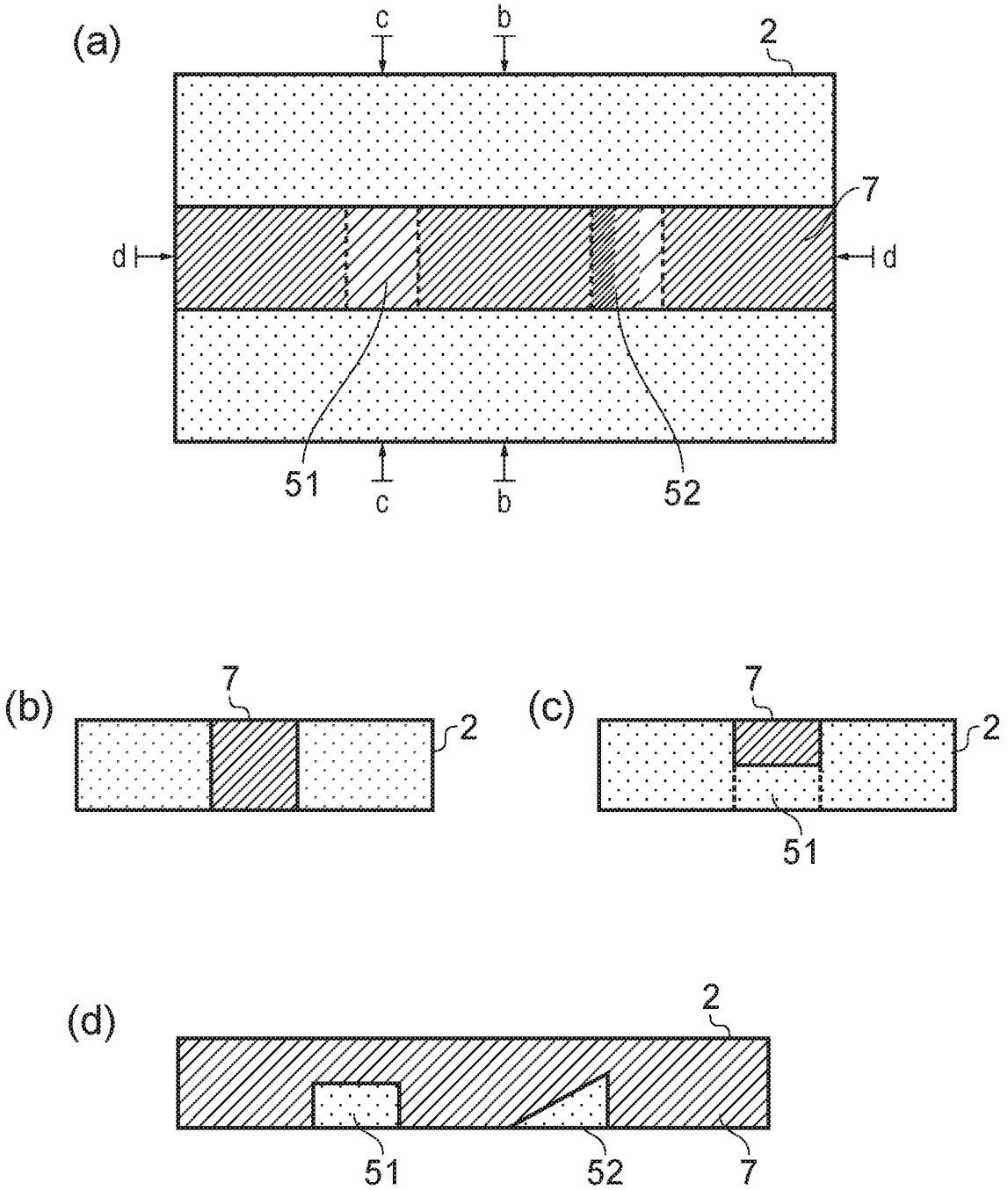

FIG. 14 shows various schematic views of a substrate fabricated in a positive regime. FIG. 14(*a*) shows a top, plan view of the substrate 2. A channel 7 has been written along it by exposing that area of the substrate surface 2 to a laser beam. The hashed shading indicates the exposed area, with the density of the shading representing the fluence. Two areas 51, 52 have received less exposure, so will have had a light-sensitive substance state change to a lesser depth and hence will become partial barriers in the channel 7. The main part of the channel 7, however, has received sufficient exposure to change the state of the light-sensitive substance through the full depth of the substrate 2. After development, the hashed regions will be hydrophilic so that fluid can flow along the channel 7. The dotted shading indicates those areas of the substrate which have not been exposed to the laser beam, and hence will remain solid after the developing stage.

FIG. 14(*b*) shows a cross-section through the substrate 2 along line 'b' in FIG. 14(*a*), perpendicular to the length of the channel 7. At this point, there is no barrier, and the laser exposure has penetrated the full thickness of the substrate 2. Hence the channel 7, formed from hydrophilic substrate material (hashed) after development, extends right through the substrate 2, and is bounded on each side by the solid material (dotted).

FIG. 14(*c*) shows a cross-section through the substrate 2 along line 'c' in FIG. 14(*a*), perpendicular to the length of the channel 7. At this point, there is a partial barrier formed under area 51 of the substrate 2. Hence, the hydrophilic material (hashed) defining the channel 7 extends only part of the way through the substrate 2, and the bottom part of the channel is filled with solid material (dotted) that was not exposed to the laser beam, creating a partial barrier to fluid flow.

FIG. 14(*d*) shows a cross-section through the substrate 2 along the line 'd' in FIG. 14(*a*), along the length of the channel 7. Most of the substrate material has been exposed to the laser energy, to define the hydrophilic region (hashed) of the channel 7 through the full depth of the substrate 2. Under the area 51 there is a partial barrier of constant height formed from solid material (dotted) that did not receive any laser energy and remained in its first state. A uniform fluence over area 51 produced a partial barrier of constant depth (or height). Under the area 52 there is a one-directional flow barrier of increasing height formed from solid material (dotted) that did not receive any laser energy and remained in its first state. A varied fluence over area 52 produced a barrier of increasing depth (or height).

Fabrication of a device using a positive regime may be summarised as a method of making a fluid flow device comprising: impregnating a substrate of porous material with a light-sensitive substance in a first, solid, state and configured to change to a second state when exposed to light; exposing a beam of light onto the substrate; and creating a fluid flow channel in the substrate by causing translational movement between the substrate surface and the beam of light to expose a line on the substrate surface and hence deliver energy to a volume of the substrate under the line to change the light-sensitive material to its second state in the volume, while controlling an amount of energy delivered by the light to control the depth of the volume changed to the second state such that parts of the volume are changed to the second state to a depth in the substrate that is a desired depth of the channel while at least one part of the volume is changed to the second state to a depth less than the depth of the channel to create a partial barrier to flow of fluid along the channel; and developing the substrate in a solvent to remove the light-sensitive substance in the second state and leave the light sensitive substance in the first, solid, state. The impregnation step can be performed in any convenient manner, depending on the type of light-sensitive substance used. For example, the substance might have an initial liquid form so that the impregnation comprises soaking the substrate in the liquid, and then heating or baking it to transform the substance into a solid form.

Conversely, fabrication of a device using a negative regime may be summarised as a method of making a fluid flow device comprising: providing a substrate of porous material impregnated with a light-sensitive substance in a first state which is configured to change to a second, solid, state when exposed to light, the substrate having a thickness and having a fluid flow channel defined by a spaced-apart pair of solid barrier walls extending the full thickness of the substrate; directing a beam of light onto an area of the substrate between the solid barrier walls; creating a partial barrier to flow of fluid along the fluid flow channel by controlling an amount of energy delivered by the light onto the area to change the light-sensitive substance to its second state in a volume of the substrate below the area and within the fluid flow channel that has a depth less than a thickness of the substrate; and developing the substrate in a solvent that removes light-sensitive substance that remains in the first state.

Features of Various Embodiments

The methods of the present invention offer a number of improvements and advantages over known techniques for microfluidic device fabrication, some of which have been already mentioned. The direct laser writing provides controllable solid fluid-flow resistant feature formation in the thickness of a porous substrate, by a positive or negative light-sensitive regime. This enables a range of structures including flow channels and barriers to flow to be written using the same technique, and in some cases in a single writing step. Flow delay can be controlled with precision according to the size and shape of the barriers, which can be readily varied by simple adjustments during the laser writing. The methods are non-contact and can use bio-compatible polymer materials so are suitable for the production of diagnostic devices. No exposure masks are needed, as compared to known photolithography techniques, which reduces cost and complexity. Small features sizes are achievable, enabling the fabrication of highly compact devices. The processes are equally applicable to large scale mass production and one-off production of single devices.

REFERENCES

[1] P. Yager, T. Edwards, E. Fu, K. Helton, K. Nelson, M. R. Tam, and B. H. Weigl, "Microfluidic diagnostic technologies for global public health," Nature 442, 412-418 (2006)

[2] X. Li, D. R. Ballerini, and W. Shen, "A perspective on paper-based microfluidics: Current status and future trends," Biomicrofluidics 6, 11301-1130113 (2012)

[3] R. Pelton, "Bioactive paper provides a low-cost platform for diagnostics," Trac-Trends Anal. Chem. 28, 925-942 (2009)

[4] A. K. Yetisen, M. S. Akram, and C. R. Lowe, "Paper-based microfluidic point-of-care diagnostic devices," Lab Chip 13, 2210-2251 (2013)

[5] A. W. Martinez, S. T. Phillips, M. J. Butte, and G. M. Whitesides, "Patterned paper as a platform for inexpensive, low-volume, portable bioassays," Angew. Chem.-Int. Edit. 46, 1318-1320 (2007)

[6] WO 2008/049083

[7] WO 2012/125781

[8] D. A. Bruzewicz, M. Reches, and G. M. Whitesides, "Low-cost printing of poly(dimethylsiloxane) barriers to define microchannels in paper," Anal. Chem. 80, 3387-3392 (2008)

[9] K. Abe, K. Suzuki, and D. Citterio, "Inkjet-printed microfluidic multianalyte chemical sensing paper," Anal. Chem. 80, 6928-6934 (2008)

[10] X. Li, J. F. Tian, T. Nguyen, and W. Shen, "Paper-Based Microfluidic Devices by Plasma Treatment," Anal. Chem. 80, 9131-9134 (2008)

[11] E. M. Fenton, M. R. Mascarenas, G. P. Lopez, and S. S. Sibbett, "Multiplex Lateral-Flow Test Strips Fabricated by Two-Dimensional Shaping," ACS Appl. Mater. Interfaces 1, 124-129 (2009)

[12] Y. Lu, W. W. Shi, L. Jiang, J. H. Qin, and B. C. Lin, "Rapid prototyping of paper-based microfluidics with wax for low-cost, portable bioassay," Electrophoresis 30, 1497-1500 (2009)

[13] E. Carrilho, A. W. Martinez, and G. M. Whitesides, "Understanding Wax Printing: A Simple Micropatterning Process for Paper-Based Microfluidics," Anal. Chem. 81, 7091-7095 (2009)

[14] X. Li, J. F. Tian, G. Gamier, and W. Shen, "Fabrication of paper-based microfluidic sensors by printing," Colloid Surf. B-Biointerfaces 76, 564-570 (2010)

[15] J. L. Delaney, C. F. Hogan, J. F. Tian, and W. Shen, "Electrogenerated Chemiluminescence Detection in Paper-Based Microfluidic Sensors," Anal. Chem. 83, 1300-1306 (2011)

[16] J. Olkkonen, K. Lehtinen, and T. Erho, "Flexographically Printed Fluidic Structures in Paper," Anal. Chem. 82, 10246-10250 (2010)

[17] W. Dungchai, O. Chailapakul, and C. S. Henry, "A low-cost, simple, and rapid fabrication method for paper-based microfluidics using wax screen-printing," Analyst 136, 77-82 (2011)

[18] G. Chitnis, Z. W. Ding, C. L. Chang, C. A. Savran, and B. Ziaie, "Laser-treated hydrophobic paper: an inexpensive microfluidic platform," Lab Chip 11, 1161-1165 (2011)

[19] A. Apilux, et al, Lab Chip 13, 126-135 (2013)

[20] E. Fu et al, Lab Chip 10, 918-920 (2010)

[21] B. Lutz et al., Lab Chip 13, 2840-2847 (2013)

The invention claimed is:

1. A method of making a fluid flow device comprising:

providing a substrate of porous material impregnated with a light-sensitive substance in a first state and which is configured to change state from the first state to a second state when exposed to light, one of the first state and the second state being a solid state that is resistant to a solvent and the other of the first and second state being removable with the solvent, the substrate having a fluid flow channel defined therein, and the channel having a depth;

exposing a beam of light onto an area of the substrate surface within the fluid flow channel to deliver energy to a volume of the substrate below the area to change the light-sensitive substance to the second state;

during exposure, creating a partial barrier to flow of fluid along the channel by controlling the amount of energy delivered to the volume below at least part of the area to change the light-sensitive substance to the second state in a volume of the substrate within the fluid flow channel that has a depth less than the depth of the fluid flow channel; and developing the substrate in the solvent to leave the light-sensitive substance which is in the solid state and remove the light-sensitive material which is in the other state;

in which the partial barrier is created to have a depth which varies along an intended direction of flow along the channel, by delivering a varying amount of energy across the area.

2. A method according to claim 1, in which the porous material is paper.

3. A method according to claim 1, in which the porous material is nitrocellulose.

4. A method according to claim 1, in which controlling the amount of energy delivered by the light onto the area comprises controlling an intensity of the light.

5. A method according to claim 1, in which exposing the beam of light onto the area comprises causing relative translation between the substrate surface and the beam of light.

6. A method according to claim 5, in which controlling the amount of energy delivered by the light onto the area comprises controlling a speed of the relative translation.

7. A method according to claim 1, further comprising creating one or more further partial barriers.

8. A method according to claim 1, in which the substrate has one or more further fluid flow channels defined therein.

9. A method according to claim 8, in which the fluid flow channels are located at two or more different depths within a thickness of the substrate.

10. A method according to claim 1, in which the second state of the light-sensitive substance is solid, the volume of light-sensitive substance changed to the second state forms the partial barrier, and developing the substrate comprises removing the light sensitive material in the first state.

11. A method according to claim 10, in which providing the substrate having a fluid flow channel defined therein comprises:

impregnating a substrate of porous material having a thickness with a light-sensitive substance in a first state and which is configured to change state from the first state to a second state on exposure to light, the second state being a solid state that is resistant to a solvent and the first state being removable with the solvent;

exposing a beam of light onto the substrate surface;

creating solid barrier walls to define the fluid flow channel by causing translational movement between the substrate surface and the beam of light to expose a pair of spaced-apart lines on the substrate while controlling an amount of energy delivered by the light so as to change the light-sensitive substance to the solid second state in a volume of the substrate below each line that extends through the thickness of the substrate; and developing the substrate in the solvent to remove light-sensitive substance in the first state.

12. A method according to claim 11, in which creating the solid barrier walls and creating the partial barrier are carried out as a combined step, following a single step of impregnating the substrate and before a single step of developing the substrate.

13. A method according to claim 1, in which the first state of the light-sensitive substance is solid, the partial barrier is formed by a volume of the substrate under the volume of light-sensitive substance changed to the second state, and developing the substrate comprises removing the light-sensitive material in the second state.

14. A method according to claim 13, in which providing the substrate having a fluid flow channel defined therein comprises:

impregnating a substrate of porous material with a light-sensitive substance in a first state and which is configured to change state from the first state to a second state on exposure to light, the first state being a solid state that is resistant to a solvent and the second state being removable with the solvent;

exposing a beam of light onto the substrate surface;

creating the channel by causing translational movement between the substrate surface and the beam of light to expose a line having a width corresponding to a desired width of the channel while controlling an amount of energy delivered by the light so as to change the light-sensitive substance into the second state in a volume of the substrate below the line that extends a desired depth of the channel; and developing the substrate in the solvent to leave the light-sensitive substance in the solid first state and remove the light-sensitive material in the second state.

15. A method according to claim 14, wherein the step of impregnating the substrate comprises impregnating the substrate with a solution that forms the first state of the light-sensitive substance when heated or dried, and heating or drying the substrate to transform the solution into the light-sensitive substance in its first state.

16. A method of making a fluid flow device comprising:

providing a substrate of porous material impregnated with a light-sensitive substance in a first state and which is configured to change state from the first state to a second state when exposed to light, one of the first state and the second state being a solid state that is resistant to a solvent and the other of the first and second state being removable with the solvent, the substrate having a fluid flow channel defined therein, and the channel having a depth;

exposing a beam of light onto an area of the substrate surface within the fluid flow channel to deliver energy to a volume of the substrate below the area to change the light-sensitive substance to the second state;

during exposure, creating a partial barrier to flow of fluid along the channel by controlling the amount of energy delivered to the volume below at least part of the area to change the light-sensitive substance to the second state in a volume of the substrate within the fluid flow channel that has a depth less than the depth of the fluid flow channel; and developing the substrate in the solvent to leave the light-sensitive substance which is in the solid state and remove the light-sensitive material which is in the other state;

in which the partial barrier is created to have a depth which varies such that the partial barrier depth increases or decreases in a linear, a non-linear or a step-wise manner along an intended direction of flow of fluid along the channel, by delivering a varying amount of energy across the area.

17. A method of making a fluid flow device comprising:

providing a substrate of porous material impregnated with a light-sensitive substance in a first state and which is configured to change state from the first state to a second state when exposed to light, one of the first state and the second state being a solid state that is resistant to a solvent and the other of the first and second state being removable with the solvent, the substrate having a fluid flow channel defined therein, and the channel having a depth;

exposing a beam of light onto an area of the substrate surface within the fluid flow channel to deliver energy to a volume of the substrate below the area to change the light-sensitive substance to the second state;

during exposure, creating a partial barrier to flow of fluid along the channel by controlling the amount of energy delivered to the volume below at least part of the area to change the light-sensitive substance to the second state in a volume of the substrate within the fluid flow channel that has a depth less than the depth of the fluid flow channel; and developing the substrate in the solvent to leave the light-sensitive substance which is in the solid state and remove the light-sensitive material which is in the other state;

in which the first state of the light-sensitive substance is solid, the partial barrier is formed by a volume of the substrate under the volume of light-sensitive substance changed to the second state, and developing the substrate comprises removing the light-sensitive material in the second state;

in which providing the substrate having a fluid flow channel defined therein comprises:

impregnating a substrate of porous material with a light-sensitive substance in a first state and which is configured to change state from the first state to a second state on exposure to light, the first state being a solid state that is resistant to a solvent and the second state being removable with the solvent;

exposing a beam of light onto the substrate surface;

creating the channel by causing translational movement between the substrate surface and the beam of light to expose a line having a width corresponding to a desired width of the channel while controlling an amount of energy delivered by the light so as to change the light-sensitive substance into the second state in a volume of the substrate below the line that extends a desired depth of the channel; and developing the substrate in the solvent to leave the light-sensitive substance in the solid first state and remove the light-sensitive material in the second state; and in which creating the channel and creating the partial barrier are carried out as a combined step, following a single step of impregnating the substrate and before a single step of developing the substrate, wherein creating the partial barrier comprises delivering a lesser amount of energy at part of the line than the energy delivered to change the light-sensitive substance to the second state to the desired depth of the channel.

18. A fluid flow device fabricated using a method according to claim 1.

* * * * *